US009139800B2

(12) United States Patent
Monsrud et al.

(10) Patent No.: US 9,139,800 B2
(45) Date of Patent: Sep. 22, 2015

(54) CONCENTRATED WAREWASHING COMPOSITIONS AND METHODS

(75) Inventors: Lee J. Monsrud, Inver Grove Heights, MN (US); Steven J. Lange, St. Paul, MN (US); Altony J. Miralles, Woodbury, MN (US); Michael S. Rischmiller, Inver Grove Heights, MN (US)

(73) Assignee: Ecolab USA Inc., St. Paul, MN (US)

( * ) Notice: Subject to any disclaimer, the term of this patent is extended or adjusted under 35 U.S.C. 154(b) by 577 days.

(21) Appl. No.: 13/474,780

(22) Filed: May 18, 2012

(65) Prior Publication Data

US 2013/0146102 A1 Jun. 13, 2013

Related U.S. Application Data

(60) Provisional application No. 61/569,898, filed on Dec. 13, 2011.

(51) Int. Cl.
*B08B 3/02* (2006.01)
*B08B 3/08* (2006.01)
(Continued)

(52) U.S. Cl.
CPC ... *C11D 7/06* (2013.01); *B08B 3/02* (2013.01); *B08B 3/08* (2013.01); *B08B 9/20* (2013.01); *C11D 3/042* (2013.01); *C11D 3/044* (2013.01); *C11D 3/2086* (2013.01); *C11D 3/323* (2013.01); *C11D 7/08* (2013.01); *C11D 7/265* (2013.01);
(Continued)

(58) Field of Classification Search
CPC ..... B08B 3/02; B08B 3/08; B08B 9/20
USPC ..... 134/25.2, 25.3, 26, 28, 29, 42
See application file for complete search history.

(56) References Cited

U.S. PATENT DOCUMENTS 3,007,479 A 11/1961 Jacobs et al.
3,888,269 A 6/1975 Bashark
(Continued)

FOREIGN PATENT DOCUMENTS

DE 1628632 8/1970
DE 2343145 3/1975
(Continued)

OTHER PUBLICATIONS

Ecolab USA Inc. et al., PCT/IB2012/052521, "Notification of Transmittal of The International Search Report and The Written Opinion of the International Searching Authority, or the Declaration" mailed Jan. 24, 2013.
(Continued)

*Primary Examiner* — Saeed T Chaudhry
(74) *Attorney, Agent, or Firm* — McKee, Voorhees & Sease, PLC

(57) ABSTRACT

The invention generally relates to concentrated warewashing compositions and methods of using the same. In some aspects, the invention uses concentrated compositions in methods of warewashing where the concentrate is applied directly to the article to be cleaned, rather than dispensed into a sump and applied to the article as a ready-to-use composition. In additional aspects, the methods of using highly concentrated alkaline and/or acid compositions in an alternating pattern of alkaline-acid-alkaline or acid-alkaline-acid, or the like, provide substantially similar or superior cleaning efficacy while reducing the overall consumption of the alkaline and/or acid compositions.

20 Claims, 4 Drawing Sheets

(51) Int. Cl.

| | |
|---|---|
| ***B08B 9/20*** | (2006.01) |
| ***C11D 7/06*** | (2006.01) |
| ***C11D 7/08*** | (2006.01) |
| ***C11D 7/26*** | (2006.01) |
| ***C11D 7/32*** | (2006.01) |
| ***C11D 11/00*** | (2006.01) |
| ***C11D 3/04*** | (2006.01) |
| ***C11D 3/20*** | (2006.01) |
| ***C11D 3/32*** | (2006.01) |

(52) U.S. Cl.
CPC ..... *C11D 7/3272* (2013.01); *C11D 11/0023* (2013.01); *C11D 11/0064* (2013.01)

(56) References Cited

U.S. PATENT DOCUMENTS

| | | | | |
|---|---|---|---|---|
| 3,896,827 | A | 7/1975 | Robinson | |
| 4,313,451 | A | 2/1982 | Vilen | |
| 4,362,953 | A | 12/1982 | Bolin | |
| 5,525,161 | A | 6/1996 | Milocco et al. | |
| 5,704,380 | A | 1/1998 | Zelniker et al. | |
| 5,725,002 | A | 3/1998 | Payzant | |
| 5,783,540 | A | 7/1998 | Secemski et al. | |
| 5,879,469 | A | 3/1999 | Avram | |
| 5,972,870 | A | 10/1999 | Anderson | |
| 6,098,639 | A | 8/2000 | Robinson | |
| 6,218,349 | B1 | 4/2001 | Kravitz et al. | |
| 7,415,983 | B2 | 8/2008 | Griese et al. | |
| 8,092,613 | B2 | 1/2012 | Strothoff et al. | |
| 2002/0065205 | A1 | 5/2002 | Neplenbroek et al. | |
| 2004/0173244 | A1 | 9/2004 | Strothoff et al. | |
| 2004/0194810 | A1* | 10/2004 | Strothoff et al. | 134/25.2 |
| 2006/0201537 | A1 | 9/2006 | Strothoff et al. | |
| 2008/0015133 | A1 | 1/2008 | Rigley et al. | |
| 2011/0308553 | A1 | 12/2011 | Strothoff et al. | |

FOREIGN PATENT DOCUMENTS

| | | |
|---|---|---|
| DE | 3326459 | 1/1985 |
| DE | 19503060 | 8/1996 |
| EP | 0151203 | 8/1985 |
| EP | 0217732 | 4/1987 |
| EP | 0282214 | 9/1988 |
| EP | 0761156 | 3/1997 |
| EP | 0806472 | 11/1997 |
| EP | 0808894 | 11/1997 |
| EP | 1026230 | 8/2000 |
| EP | 1239028 | 9/2002 |
| EP | 1477552 | 11/2004 |
| FR | 2206382 | 11/1972 |
| GB | 798274 | 4/1959 |
| GB | 1027309 | 4/1966 |
| WO | 9107904 | 6/1991 |
| WO | 9218047 | 10/1992 |
| WO | 9305696 | 4/1993 |
| WO | 9514424 | 6/1995 |
| WO | 9524148 | 9/1995 |
| WO | 9830673 | 7/1998 |
| WO | 9900474 | 1/1999 |
| WO | 0043145 | 7/2000 |
| WO | 0231095 | 4/2002 |
| WO | 02100993 | 12/2002 |
| WO | 2004052564 | 6/2004 |
| WO | 2004101727 | 11/2004 |

OTHER PUBLICATIONS

DE 1 628 632—Henkel & Cie GmbH—English Translation Aug. 20, 1970.

DE 23 43 145—Henkel & Cie GmbH—English Translation Mar. 13, 1975.

DE 33 26 459 A1—Etol-Werk GmbH & Co—English Translation Jan. 31, 1985.

DE 195 03 060 A1—Henkel-Ecolab GmbH & Co—English Translation Aug. 8, 1996.

EP 0 217 732 A1—Almaca Bioprodukte Herstellungs GmbH—English Translation Apr. 8, 1987.

EP 0 806 472—Chemische Fabrik Dr. Weigert (GmbH & Co.)—English Translation Nov. 12, 1997.

EP 0 808 894—Chemische Fabrik Dr. Weigert (GmbH & Co.)—English Translation Nov. 26, 1997.

FR 2-206-382—Diversey-France S.A.—English Translation Nov. 10, 1972.

WO 02/100993—Ecolab GmbH & Co. OHG—English Translation Dec. 19, 2002.

WO 91/07904—Henkel Kommanditgesellschaft Auf Aktien—English Translation Jun. 13, 1991.

WO 92/18047—Henkel Kommanditgesellschaft Auf Aktien—English Translation Oct. 29, 1992.

WO 93/05696—Henkel Kommanditgesellschaft Auf Aktien—English Translation Apr. 1, 1993.

* cited by examiner

CONCENTRATED WAREWASHING COMPOSITIONS AND METHODS

CROSS-REFERENCE TO RELATED APPLICATIONS

This application claims priority and is related to U.S. Provisional Application Ser. No. 61/569,898 filed on Dec. 13, 2011, entitled Concentrated Warewashing Compositions and Methods. The entire contents of this patent application are hereby expressly incorporated herein by reference including, without limitation, the specification, claims, and abstract, as well as any figures, tables, or drawings thereof

FIELD OF THE INVENTION

The invention relates to concentrated warewashing compositions and methods of using concentrated warewashing compositions. In particular, methods of using concentrated compositions in warewashing directly apply the concentrate to the article in need of cleaning instead of dispensing compositions into a sump and applying to the article as a ready-to-use composition. In addition, concentrated warewashing compositions may use alkaline compositions and acidic compositions in an alternating pattern of alkaline-acid-alkaline or acid-alkaline-acid, or the like, where at least one composition is a concentrated composition that is applied directly to the article to be cleaned resulting in improved cleaning efficacy and a reduction in alkaline/acid consumption.

BACKGROUND OF THE INVENTION

Dishmachines, particularly commercial dishmachines, have to effectively clean a variety of articles such as pots and pans, glasses, plates, bowls, and utensils. These articles include a variety of soils including protein, fat, starch and sugar, which can be difficult to remove. At times, these soils may be burnt or baked on, or otherwise thermally degraded. Often times, the soil may have been allowed to remain on the surface for a period of time, making it more difficult to remove. Dishmachines remove soil by using a combination of detergents, temperatures, sanitizers or mechanical action from water. It is against this background that the present disclosure is made.

Accordingly, it is an objective of the claimed invention to develop concentrated compositions and methods of using the same for warewashing applications to enhance cleaning performance.

A further object of the invention is to provide methods for reducing alkaline and/or acid composition and/or energy consumption required for warewashing methods.

A still further object of the invention is to provide improvements in systems with alternating pH chemistry, including the reduction of detergent demand, elimination of detergent conductivity controllers, reduced water usage and/or reduced energy demands.

BRIEF SUMMARY OF THE INVENTION

Surprisingly, it has been found that concentrated compositions can be used in methods of warewashing where the concentrate is applied directly to the article to be cleaned, rather than applied to a sump, or otherwise diluted, and then applied to the article as a ready-to-use composition. Applying the concentrate directly to the article advantageously allows the concentrated chemistry to directly contact the food soil. This is also advantageous when used in a system with alternating pH chemistry. The result is that more concentrated chemistry contacts the article to be cleaned and less chemistry has to be used because excess chemistry is no longer needed to overcome a pH shift. Even though less chemistry is being used, the chemistry is more effective at removing soil from articles in a dishmachine compared to ready-to-use or diluted versions of the chemistry. This is believed to be in part because of the extreme pH shift that occurs on the soil on the article as well as the exotherm that is released on the soil. After the chemistry is applied to the article, it is allowed to drain into the sump.

In some aspects of the invention, methods of cleaning articles in a dishmachine are disclosed and may include: applying directly to the article a first concentrated cleaning composition comprising: (i) from about 1 wt-% to about 90 wt-% of a source of alkalinity or a source of acidity; (ii) optional materials selected from the group consisting of surfactant, thickener, chelating agent, bleaching agent, catalyst, enzyme, solidification agent and mixtures thereof; and (iii) water. In some aspects, the concentration of the alkaline or acidic composition has a higher concentration of active materials than conventional dishwashing compositions. In one aspect the alkaline or acidic composition has at least 20 wt-% active ingredients. The method also includes applying to the article a second composition selected from the group consisting of a first acidic cleaning composition, a first alkaline cleaning composition, a second acidic cleaning composition, a second alkaline cleaning composition, a rinse aid composition and mixtures thereof.

In an aspect of the invention, the methods wherein the methods achieve at least a 10% reduction in alkalinity and/or acidic cleaning composition consumption in comparison to methods employing less concentrated compositions and/or compositions applied to a sump and/or diluted prior to application to the article. In other aspects, the methods achieve substantially similar cleaning efficacy to methods employing less concentrated compositions, methods applying compositions to a sump and/or otherwise diluting compositions to apply a ready-to-use composition to the article. In additional aspects, the methods achieve superior cleaning efficacy.

In some aspects, the methods include forming a concentrated alkaline or acidic cleaning composition by dissolving a portion of a solid alkaline or acidic composition with water and spraying the concentrated cleaning composition directly onto an article to be cleaned. The method also includes applying to the article a second composition selected from the group consisting of a first acidic cleaning composition, a first alkaline cleaning composition, a second acidic cleaning composition, a second alkaline cleaning composition, a rinse aid composition, and mixtures thereof. The second composition may also be concentrated or may be diluted.

In additional aspects, the methods include forming a concentrated alkaline composition by dissolving a portion of a solid alkaline composition with water where the resulting concentrated alkaline composition has from about 0.5 wt-% to about 80 wt-% of a source of alkalinity and additional functional ingredients. The method includes spraying the concentrated alkaline composition directly onto an article to be cleaned and then spraying a concentrated acidic composition on the article to be cleaned. The compositions may be sprayed on the article to be cleaned using a wash arm, a rinse arm or spray nozzles. The concentrated acidic composition includes from about 0.4 wt-% to about 80 wt-% of an acid plus additional functional ingredients.

These and other embodiments will be apparent to those of skill in the art and others in view of the following detailed description of some embodiments. It should be understood, however, that this summary, and the detailed description illustrate only some examples of the various embodiments, and are not intended to be limiting to the claimed invention. Figures represented herein are not limitations to the various embodiments according to the invention and are presented for exemplary illustration of the invention.

Figure 1:
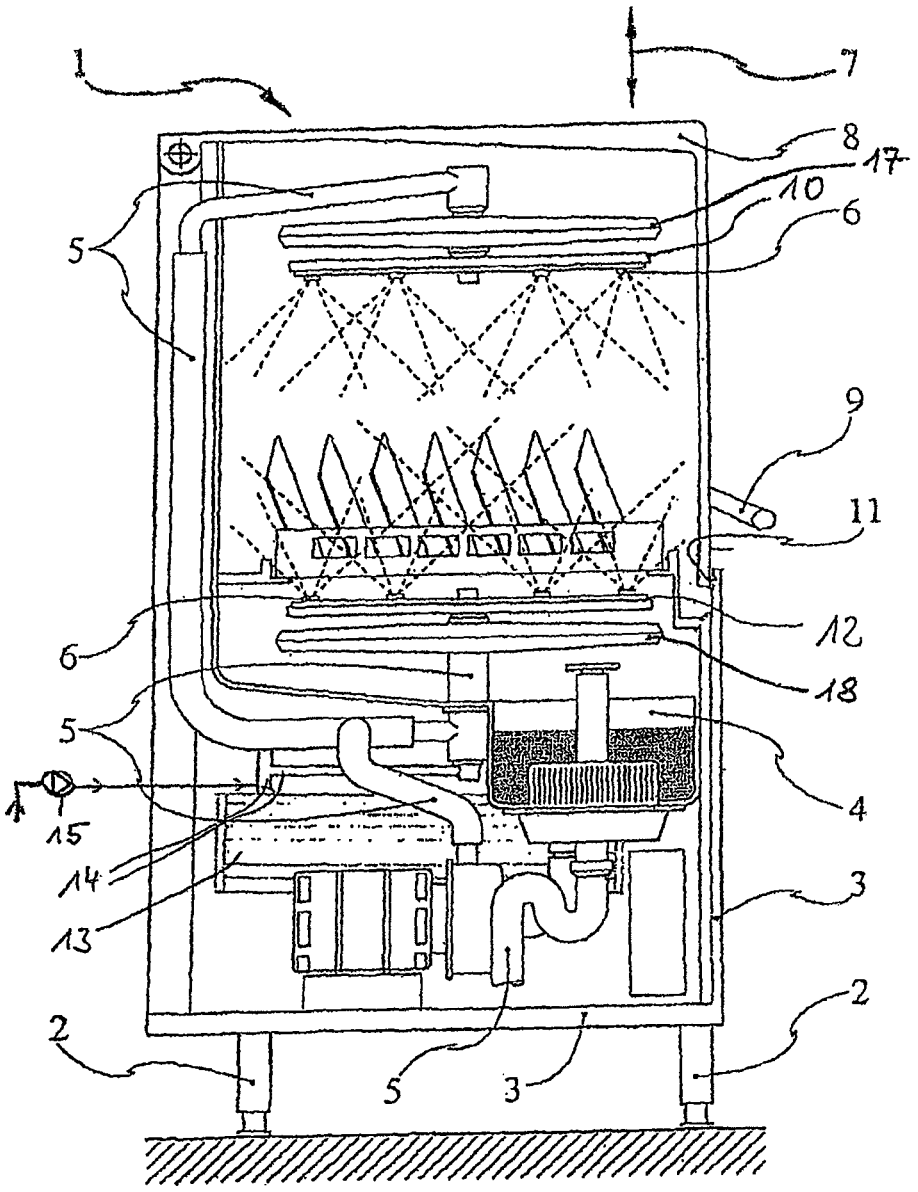
FIG. 1 shows a door dish machine where the concentrated warewashing composition is applied through the rinse arm of the dish machine according to an embodiment of the invention.

Various embodiments of the present invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION

The embodiments of this invention are not limited to particular concentrated warewashing compositions and methods of using the same, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form. Numeric ranges recited within the specification are inclusive of the numbers defining the range and include each integer within the defined range.

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

As used herein, the term "cleaning" means to perform or aid in soil removal, bleaching, de-scaling, de-staining, microbial population reduction, rinsing, or combination thereof.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both. In an embodiment of the invention, the use of the concentrated alkalinity and/or acid compositions in the alternating alkaline-acid-alkaline manner provide at least substantially similar cleaning performance, and in many embodiments provide superior cleaning performance, to conventional application of less concentrated alkalinity and/or acid compositions.

As used herein, the term "ware" includes items such as for example eating and cooking utensils. As used herein, the term "warewashing" refers to washing, cleaning and/or rinsing ware.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods, systems, apparatuses, and compositions of the present invention may comprise, consist essentially of, or consist of the component and ingredients of the present invention as well as other ingredients described herein. As used herein, "consisting essentially of" means that the methods, systems, apparatuses and compositions may include additional steps, components or ingredients, but only if the additional steps, components or ingredients do not materially alter the basic and novel characteristics of the claimed methods, systems, apparatuses, and compositions.

It should also be noted that, as used in this specification and the appended claims, the term "configured" describes a system, apparatus, or other structure that is constructed or configured to perform a particular task or adopt a particular configuration. The term "configured" can be used interchangeably with other similar phrases such as arranged and configured, constructed and arranged, adapted and configured, adapted, constructed, manufactured and arranged, and the like.

Methods of Using Concentrated Warewashing Compositions

The disclosure generally relates to concentrated warewashing compositions and methods of using concentrated warewashing compositions. The methods of the invention beneficially result in eliminating the use of excess detergent consumption (alkaline and/or acid) in warewashing applications, reducing overall water consumption in warewashing applications, reducing overall energy consumption in warewashing applications, and improving cleaning efficacy. Without being limited to a particular theory of the invention, the methods provide improved cleaning efficacy in part due to the direct application of the alkaline and/or acid compositions to the articles in need of cleaning This is distinct from conventional warewashing methods which apply compositions to a dishmachine sump, dilute the compositions with water, and/or otherwise provide less-concentrated, ready-to-use compositions for cleaning, as opposed to highly concentrated compositions.

The disclosure includes methods of warewashing using concentrated warewashing compositions. In some embodiments, the methods include applying the concentrated compositions directly to an article to be cleaned, which bypasses first applying the concentrated compositions to the dishmachine sump. The method of warewashing where the concentrate is applied directly to the article to be cleaned obviates the dispensing of the concentrate into a sump and thereafter applying the concentrate composition to the article as a ready-to-use composition (e.g. diluted). Applying the concentrate directly to the article advantageously allows the concentrated chemistry to directly contact any soils. The direct application of the concentrated composition to the article may be conducted by pumping the composition onto the article using a pump or other means (e.g. aspirator), directly spraying the composition onto the articles (e.g. ready-to-use) or can be diluted slightly with water before spraying onto the articles. As a skilled artisan will appreciate, the speed of the pump for each concentrated composition may be adjustable to deliver more or deliver less of the composition.

In some embodiments, the methods include applying to the article an alkaline composition, an acidic composition and an alkaline composition where either the alkaline composition, the acidic composition, or both the alkaline and acidic compositions may be concentrated and applied directly to article to be cleaned. In these embodiments, the method may include additional alkaline or acidic steps where those steps may also involve dilute or concentrated compositions. In a preferred embodiment, the additional alkaline and acidic steps preferably alternate to provide an alkaline-acidic-alkaline-acidic-alkaline pattern. While it is understood that the method may include as many alkaline and acidic steps as desired, the method preferably includes at least three steps, and not more than eight steps.

The methods of applying a concentrated composition directly to the article to be cleaned are particularly advantageous when used in a system with alternating pH chemistry. For example, if a warewashing method uses alkaline chemistry and acidic chemistry in an alternating pattern of alkaline-acid-alkaline or acid-alkaline-acid, or the like, and the acidic and alkaline detergent compositions are made by diluting a concentrated detergent into a dishmachine sump and then applying the diluted chemistry to the article, excess detergent has to be applied in order to make the entire sump alkaline or acidic. For example, if an alkaline detergent is first applied and then an acidic detergent is applied, enough acidic detergent has to be diluted into the sump to overcome the alkaline pH of the sump and make the pH acidic. The same is true when taking an acidic sump to an alkaline pH. In contrast, the present method applies the concentrated chemistry directly to the article to be cleaned, resulting in direct contact between soils in need of cleaning on an article and the concentrated chemistry, thereby bypassing the sump altogether. The result is that more concentrated, and more potent, chemistry contacts the article to be cleaned and less chemistry has to be used. Less chemistry is used as a result of excess chemistry no longer being needed to overcome a pH shift of the sump. After the chemistry is applied to the article, it is allowed to drain into the sump.

Beneficially, the use of alternating highly concentrated alkaline chemistry and acidic chemistry provides enhanced cleaning results. Without being limited to a particular theory of the invention, there is significant pH shock that is induced on the articles (e.g. ware), rapidly alternating from about pH 11 to about pH 2, and back to about pH 11, in one aspect. In a preferred aspect, the methods of the invention provide an even greater pH shock by rapidly swinging the pH of the ware from about pH 13-14, to about pH 2, and then back to about pH 13-14. As a result, cleaning results are significantly improved due to the direct contact of the concentrated acid and alkaline chemicals with the soils in need of cleaning on the ware. In an aspect, an exothermic reaction occurs due to the mixing of a strong acid and a strong base (alkali) mix, resulting is surprisingly good soil removal beyond the soil removal effect of the pH shock itself. Beneficially, according to the methods of the invention, the rapid exothermic reaction occurs on the soiled ware surface, as opposed to the bulk solution.

The alternating use of the alkaline and acidic chemistries maintains the beneficial effect provided by the wash tank solution, namely providing mechanical action to remove soil when circulated through the dishmachine. For example, the forceful pumping of the wash tank solution onto the articles (e.g. ware) aids to physically removes soils. As the circulated wash tank contains a mixture of the alkaline and acidic compositions, according to the invention it is preferable to adjust the chemical ratio to favor the alkalinity. In an aspect, the wash tank pH is above about 9.5 and above about 10.5. In order to obtain the preferred alkaline pH ranges, particular alkaline and acid compositions are chosen. Strong alkalis such as NaOH and KOH contribute more alkalinity; conversely, strong acids such as HCl and phosphoric acid neutralize more of the alkalinity and lower the pH of the wash tank. In an aspect of the invention, a weak acid, such as citric, or one that donates only one proton, like urea sulfate, is preferred over a strong acid (i.e. one that donates multiple protons).

In an aspect of the invention, the use of the concentrated chemistries eliminates the need for including a detergent controller in a dishmachine. This is particularly beneficial, as the detergent controller is an expensive component in a warewashing dispensing system. Beneficially, according to the methods of the invention, a dishmachine performs better without the controller as a result of the conductivity sensor behaving erratically when acids and alkalis are being continuously mixed in the wash tank. According to the invention, the levels of chemicals in the wash tank are controlled by adjusting the amount of alkaline and/or acidic compositions sprayed during each cycle. The controlling of the spray times or spray pump speeds provides adequate control to maintain wash tank concentrations and therefore replace detergent controllers.

In an aspect of the invention, the direct application of concentrated chemistry to the articles in a dishmachine results in at least a 5% reduction in chemistry, preferably at least a 7.5% reduction, at least a 10% reduction, at least a 12.5% reduction, at least a 20% reduction, and more preferably at least a 25% reduction. In a further aspect, the direct application of a concentrated alkaline chemistry to the articles in a dishmachine results in at least a 5% reduction in alkaline chemistry, preferably at least a 10% reduction, more preferably at least a 15% reduction. In a further aspect, the direct application of a concentrated acid chemistry, after the application of a concentrated alkaline chemistry, to the articles in a dishmachine results in at least a 10% reduction in acid chemistry, preferably at least a 20% reduction, more preferably at least a 30% reduction.

In another aspect of the invention, the reduction in the amount of overall chemistry employed further results in a decreased length of a dishwashing cycle. This further results in decreased water consumption; as a result of improving the soil removal this allows a dishmachine to use less water and/or energy overall. For example, wash tank recirculation steps are the longest steps in a dishmachine wash cycle. According to the invention, when a concentrated alkaline composition is employed in place of using an alkaline recirculated tank, a recirculation step can be reduced or eliminating, thereby reducing the total cycle time (e.g. 90 second cycle can be reduced to about 60 seconds) and amount of water employed. In a further example, a door dishmachine may normally use a water spray of 4 to 6 gallons per minute (e.g. final rinse spray). Employing dishwashing methods which provide enhanced soil removal decreases the need for the amount of water and therefore the time for applying as much water in a final rinse step. This may result in the reduction of water by a few gallons of water per minute. In addition, as the final rinse water of a conventional institutional dishmachine is about 180° F., it is the largest energy consumption factor in the entire dishwashing process. Therefore, reducing the volume of water even more significantly reduces the amount of energy required to heat the rinse water.

Beneficially, using alternating pH compositions helps remove mineral deposits from hard water or coffee or tea residues. And using acidic and alkaline compositions help create a more neutral composition within a pH range from about 7 to about 9 in the final sump. In some parts of the world, the wastewater from warewashing machines must be neutralized before disposal. Therefore, having a final neutral composition in the sump is desirable because there is not a need to further neutralize the composition or pay a utility fee which saves time and money. The effect of a neutral sump still happens if concentrated alkaline and acidic compositions are used because the concentrated alkaline and acidic pHs will offset each other in the sump once they drain off the surface of the article to be cleaned. Another advantage of the more neutral sump is that certain chemicals or ingredients are more stable at neutral pH. Enzymes are one example. Since the wash sump sits for long periods of time, and elevated temperatures, enzymes and bleaches tend to decompose thus rendering their contribution to cleaning performance ineffective. Thus, the more neutral sump provides a more stable and allows the addition of chemicals that would otherwise be ineffective or short-lived.

According to embodiments of the invention, the concentrated chemistry may be applied to the article to be cleaned by spraying the composition through either the wash arm or the rinse arm of the dishmachine, or by spraying the composition through an additional spray arm or through spray nozzles.

In some embodiments, the method includes pauses between the alkaline and acid steps. For example, the method may proceed according to the following: first alkaline step, first pause, first acidic step, second pause, second alkaline step, third pause, and so on. During a pause, no further cleaning agent is applied to the article and the existing composition is allowed to stand on the dish for a period of time.

In some embodiments, the method includes a rinse or rinses. For example, the method may proceed according to the following: first alkaline step, first acidic step, second alkaline step, rinse, and so on. Alternatively, the method may proceed according to the following: first alkaline step, first pause, first acidic step, second pause, second alkaline step, third pause, rinse, and so on.

Finally, in some embodiments, the method may include an optional prewash step before the first alkaline step (or first acidic step if the first composition is acidic).

The disclosed methods can be carried out in a variety of dish machines, including consumer and institutional dish machines. The time for each step in the method may vary depending on the dishmachine, for example, if the dishmachine is a consumer dishmachine or an institutional dishmachine. The time required for a cleaning step in consumer dishmachines is typically about 10 minutes to about 60 minutes. The time required for the cleaning cycle in a US or Asian institutional dishmachine is typically about 45 seconds to about 2 minutes, depending on the type of machine. Each method step preferably last from about 2 seconds to about 30 minutes.

The temperature of the cleaning solutions in each step may also vary depending on the dishmachine, for example, if the dishmachine is a consumer dishmachine or an institutional dishmachine. The temperature of the cleaning solution in a consumer dishmachine is typically about 110° F. (43° C.) to about 150° F. (66° C.) with a rinse up to about 160° F. (71° C.). The temperature of the cleaning solution in a high temperature institutional dish machine in the US is typically about 150° F. (66° C.) to about 165° F. (74° C.) with a rinse from about 180° F. (82° C.) to about 195° F. (91° C.). The temperature of a low temperature institutional dishmachine in the US is typically about 120° F. (49° F.) to about 140° F. (60° C.). Low temperature dishmachines usually include at least a thirty second rinse with a sanitizing solution. The temperature in a high temperature institutional dishmachine in Asia is typically from about 131° F. (55° C.) to about 136° F. (58° C.) with a final rinse at 180° F. (82° C.).

The temperature of the cleaning solutions is preferably from about 95° F. (35° C.) to about 176° F. (80° C.).

Dish Machines

The methods of the invention can be carried out in a variety of dish machines, including consumer and institutional dish machines.

The disclosed methods may be carried out in any consumer or institutional dish machine. Some non-limiting examples of dish machines include door machines or hood machines, conveyor machines, undercounter machines, glasswashers, flight machines, pot and pan machines, utensil washers, and consumer dish machines. The dish machines may be either single tank or multi-tank machines. In a preferred embodiment, the dish machine is made out of acid resistant material, especially when the portions of the dish machine that contact the acidic composition do not also contact the alkaline composition.

A door dish machine, also called a hood dish machine, refers to a commercial dish machine wherein the soiled dishes are placed on a rack and the rack is then moved into the dish machine. Door dish machines clean one or two racks at a time. In such machines, the rack is stationary and the wash and rinse arms move. A door machine includes two sets arms, a set of wash arms and a rinse arm, or a set of rinse arms.

Door machines may be a high temperature or low temperature machine. In a high temperature machine the dishes are sanitized by hot water. In a low temperature machine the dishes are sanitized by the chemical sanitizer. The door machine may either be a recirculation machine or a dump and fill machine. In a recirculation machine, the detergent solution is reused, or "recirculated" between wash cycles. The concentration of the detergent solution is adjusted between wash cycles so that an adequate concentration is maintained. In a dump and fill machine, the wash solution is not reused between wash cycles. New detergent solution is added before the next wash cycle. Some non-limiting examples of door machines include the Ecolab Omega HT, the Hobart AM-14, the Ecolab ES-2000, the Hobart LT-1, the CMA EVA-200, American Dish Service L-3DW and HT-25, the Autochlor A5, the Champion D-HB, and the Jackson Tempstar.

The disclosed methods may be used in conjunction with any of the door machines described above. When the methods are used in a door machine, the door machine may need to be modified to accommodate the concentrated alkaline step and/or the acidic step. The door machine may be modified in one of several ways. In one embodiment, the alkaline or acidic composition may be applied to the dishes using the rinse spray arm or wash spray arms of the door machine. In this embodiment, the wash or rinse spray arm is connected to a reservoir for the alkaline or acidic composition. The alkaline or acidic compositions may be applied using the original nozzles of the wash or rinse arm. Alternatively, additional nozzles may be added to the wash or rinse arm for the alkaline or acidic composition. In another embodiment, an additional wash or rinse arm may be added to the door machine for the alkaline or acidic composition. In yet another embodiment, spray nozzles may be installed in the door machine for the alkaline or acidic composition. In a preferred embodiment, the nozzles are installed inside the door machine in such a way as to provide full coverage to the dish rack.

FIG. 1 shows a door dish machine modified to provide the alkaline or acid through the rinse arm of the dish machine. The dish machine (1) consists of a housing frame (3) provided with support legs (2). In the housing frame (3) there is arranged a first tank (4) for an alkaline cleaning solution. This alkaline cleaning solution is sucked out of the tank (4) using a pump (not shown) fed by means of pipe ducts (5) under pressure to spray nozzles (6) of an upper spray arm (17) and a lower spray arm (18) and sprayed onto the dishes disposed in the upper part of the door dish machine (1). After a pause, heated rinse water from boiler (13) is sprayed over an upper rinse arm (10) and a lower rinse arm (12). In order to be able to introduce soiled dishes into the dish machine (1) and remove cleaned dishes again from the dish machine (1), the dish machine (1) has in its upper part a door pivotable in the direction of the arrow (7) or a pivotable housing part (8). This pivotable housing part (8) is to be pivoted by means of a handgrip (9) by the user upwardly for opening and downwardly again for closing into the position illustrated in the figures. In area (11) the pivotable housing part (8) overlaps the housing frame part (3) in closed position. According to the embodiment of FIG. 1, the boiler (13) is connected to the rinse arm (10) and (12) by additional pipe ducts (14). Alkaline or acid from a container (not shown) can be pumped with a pump (15). Via this pipe duct (14) and the pump (15), alkaline or acidic cleaning solution and water from boiler (13) can be transported to the nozzles (6) of the rinse arms (10) and (12). The rinse arms (10) and (12) and all the pipes (14) are so constructed that the rinse arms (10) and (12) are optionally connected only to the boiler (13) for rinsing or to the boiler (13) and the pump (15) for the alkaline or acidic cleaning solution. So it is possible to alternatively spray rinse water or alkaline or acidic cleaning solution on the dishes.

Figure 2:
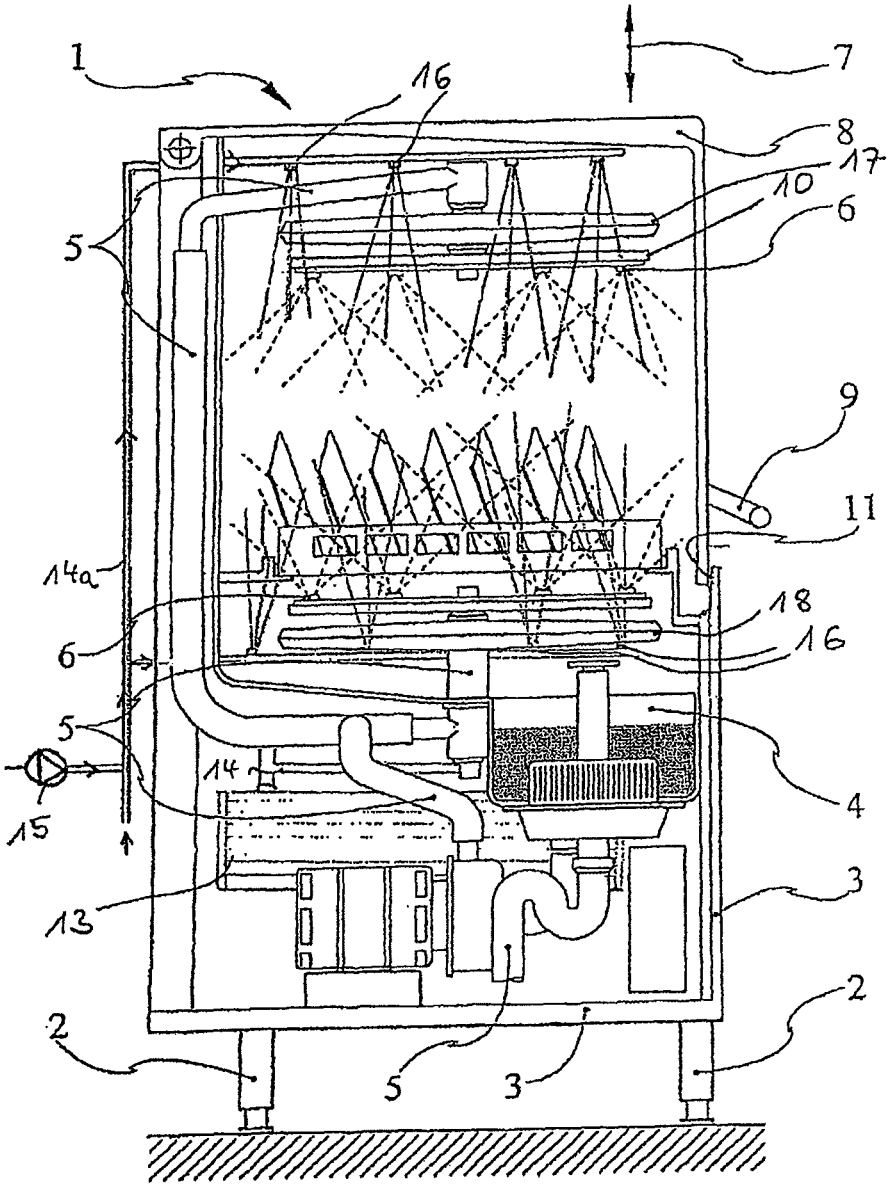
FIG. 2 shows a door dish machine where the concentrated warewashing composition is applied through spray nozzles mounted on the top and bottom of the dish machine according to an embodiment of the invention.

FIG. 2 shows a door dish machine where the alkaline or acid is applied through spray nozzles mounted on the top and bottom of the dish machine. In FIG. 2, the additional nozzles (16) in the top and bottom area of the dish machine (1) above and beneath the spray arms (17) and (18) are mounted. These nozzles (16) are connected to the pump (15) via further pipe ducts (14*a*) (diluted with water). In this way, it is possible to spray the alkaline or acidic cleaning solution over the nozzles (16).

Figure 3:
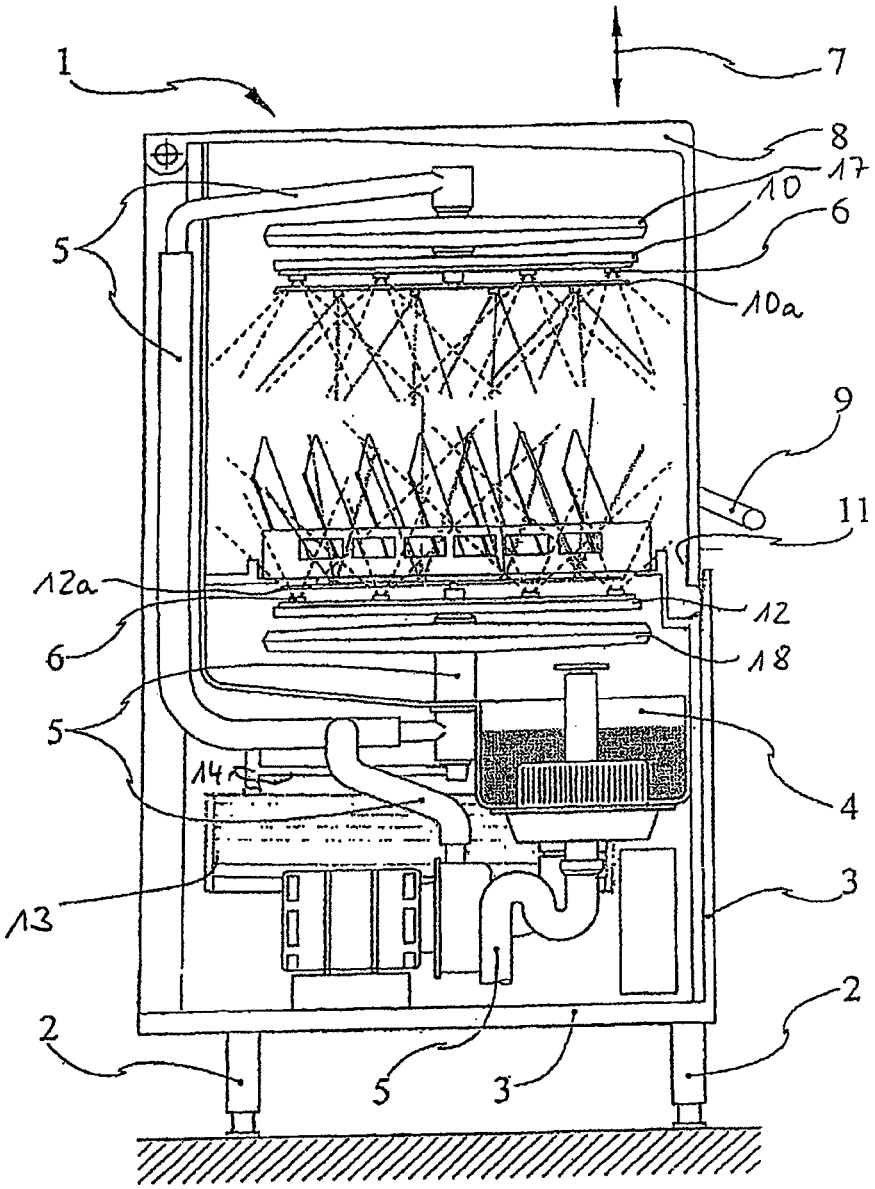
FIG. 3 shows a door dish machine where the concentrated warewashing composition is applied through a separate rinse arm according to an embodiment of the invention.

FIG. 3 shows a door dish machine where the alkaline or acid is applied through a separate rinse arm. In FIG. 3, the boiler (13) is connected to rinse arms (10) and (12) and to additional rinse arms (10*a*) and (12*a*). The additional upper rinse arm (10*a*) is arranged close to the rinse arm (10) and the additional lower rinse arm (12*a*) close to the lower rinse arm (12). These additional rinse arms (10*a*) and (12*a*) are connected with the boiler (13) and the pump (not shown) for the alkaline or acid. Here, the alkaline cleaning solution from tank (4) is sprayed over the spray arms (17) and (18) whereby the concentrated alkaline or acidic cleaning solution is sprayed over the additional rinse arms (10*a*) and (12*a*) and the rinse solution over the rinse arms (10) and (12).

Figure 4:
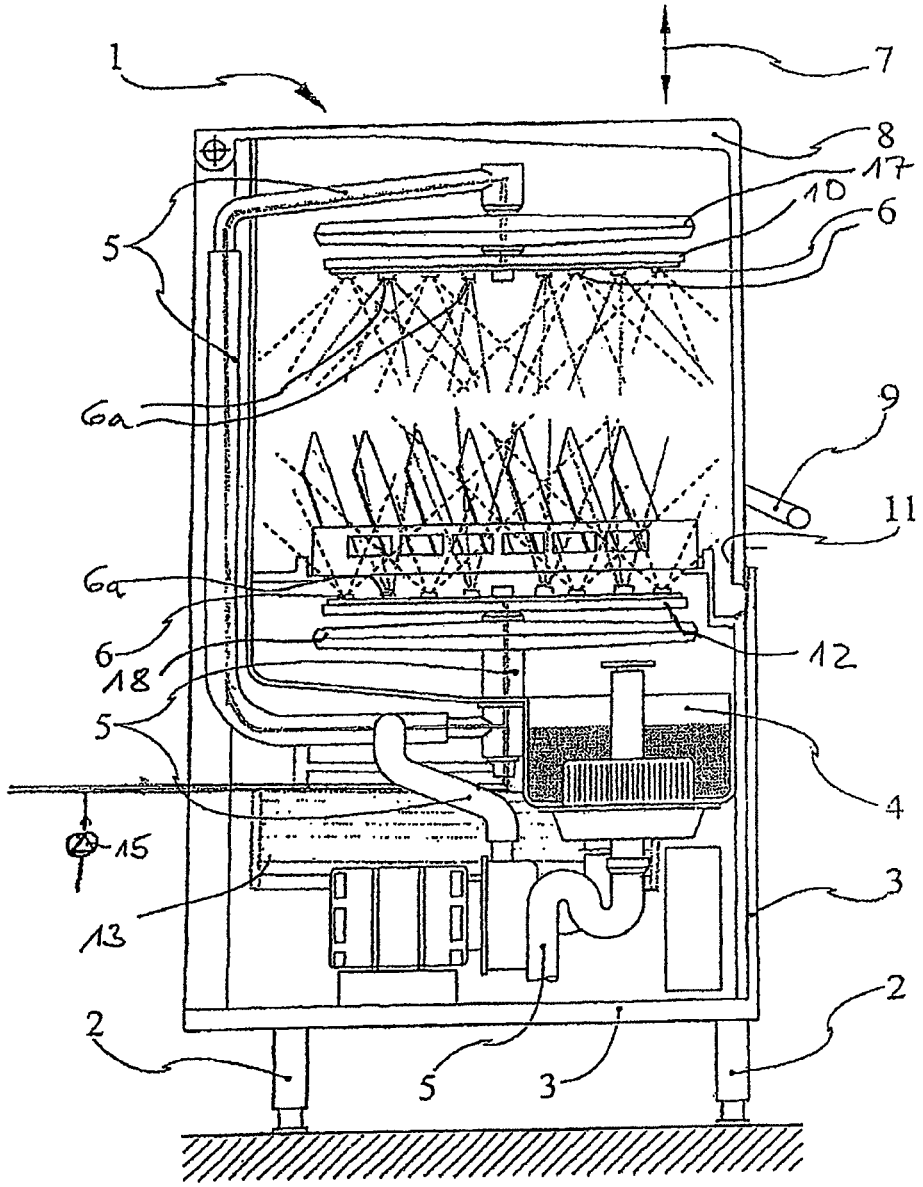
FIG. 4 shows a door dish machine where the concentrated warewashing composition is applied through additional nozzles in the rinse arm according to an embodiment of the invention.

FIG. 4 shows a door dish machine where the alkaline or acid is applied through additional nozzles (6*a*) in the rinse arm. The additional nozzles (6*a*) are connected with a water supply and a pump (15) for dosing the acid. The other nozzles (6) are connected with the boiler (13). In this case the rinse solution is sprayed over nozzles (6) of rinse arms (10) and (12) and the alkaline or acidic cleaning solution over nozzles (6*a*).

In one preferred embodiment, the door machine is modified by applying the alkaline or acidic composition through the wash arm or rinse arm of the door machine. This embodiment is advantageous because it requires less installation than if additional nozzles are added to the wash or rinse arm or if spray nozzles are added to the interior of the door machine. In another preferred embodiment, the door machine is modified by adding spray nozzles to the interior of the door machine. This embodiment is advantageous because it requires less water than when the alkaline or acidic composition is applied through the wash or rinse arm.

In addition to modifying the door machine, the door machine controller will also need to be modified to include the alkaline or acidic step.

The disclosed methods may also be used in a pot and pan and a utensil washer. Here the pot and pan and utensil washer are modified the same as the door machine. A conveyor machine refers to a commercial dish machine, wherein the soiled dishes are placed on a rack that moves through a dish machine on a conveyor. A conveyor machine continuously cleans racks of soiled dishes instead of one rack at a time. Here the manifolds are typically stationary or oscillating and the rack moves through the machine.

A conveyor machine may be a single tank or multi-tank machine. The conveyor machine may include a prewash section. A conveyor machine may be a high temperature or low temperature machine. Finally, conveyor machines primarily recirculate the detergent solution. Some non-limiting examples of conveyor machines include the Ecolab ES-4400, the Jackson AJ-100, the Stero SCT-44, and the Hobart C-44, and C-66

The disclosed methods may be used in conjunction with any of the conveyor machines described above. When the methods are used in a conveyor machine, the conveyor machine may need to be modified to accommodate the acidic step. The conveyor machine may be modified by adding spray nozzles for the acidic step between tanks for the alkaline steps. The nozzles for the acidic step are connected to an acidic composition source. The placement of the nozzles in the conveyor machine may be adjusted to provide for the application of the acidic composition at the desired time. The acidic composition may also be applied by running the acid through a wash arm.

An undercounter machine refers to a dish machine similar to most consumer dish machines, wherein the dish machine is located underneath a counter and the dishes are cleaned one rack at a time. In an undercounter dish machine, the rack is stationary and the wash/rinse arms are moving. Undercounter machines may be a high temperature or low temperature machine. The undercounter machine may either be a recirculation machine or a dump and fill machine. Some non-limiting examples of undercounter machines include the Ecolab ES-1000, the Jackson JP-24, and the Hobart LX-40H.

The disclosed methods may be used in conjunction with any of the undercounter machines described above. When the methods are used in a undercounter machine, the undercounter machine may need to be modified to accommodate the acidic step, or the cleaning compositions be modified. The undercounter machine may be modified to discard the washing water between steps and refill with fresh water. In this case the amount of cleaning agent can be lower because less will be needed to achieve the desired pH. When the washing water is not discarded between steps, the amount of cleaning agent necessary will increase because more will be needed to bring the pH to the desired level. The undercounter machine may also be modified by adding additional dosing chambers that may either be time or pressure activated.

Consumer dish machine may be modified in a way similar to the undercounter machines.

Undercounter and consumer machines are especially suited to use with a tablet.

Glasswashers may also be used with the disclosed methods. Undercounter glasswashers will be modified like an undercounter dish machine. Bar glass washers that utilize a rotary drive may be modified by incorporating additional spray nozzles and detergent reservoirs for the acid step and the second alkaline step. In addition, the wash cycle may be slowed down to accommodate the methods.

A flight machine refers to a commercial dish machine, wherein the soiled dishes are placed on pegs that move through a dish machine on a conveyor. A flight machine continuously cleans soiled dishes and racks are not used. Here the manifolds are typically stationary or oscillating and the conveyor moves through the machine.

A flight machine is typically a multi-tank machine. The flight machine may include a prewash section. A flight machine is typically a high temperature machine. Finally, flight machines typically recirculate the detergent solution. Some non-limiting examples of flight machines include the Meiko BA Series and the Hobart FT-900.

The disclosed methods may be used in conjunction with any of the flight machines described above. When the methods are used in a flight machine, the flight machine may also need to be modified to accommodate the acidic step. The flight machine may be modified by adding spray nozzles for the acidic step between tanks for the alkaline steps. The nozzles for the acidic step are connected to an acidic composition source. The placement of the nozzles in the flight machine may be adjusted to provide for the application of the acidic composition at the desired time. The acidic composition may also be applied by running the acid through a wash arm.

The above described dish machines include dispensers for dispensing the alkaline cleaning agent and the acidic cleaning agent. The dispenser may be selected from a variety of dispensers depending on the physical form of the composition. For example, a liquid composition may be dispensed using a pump, either peristaltic or bellows for example, syringe/plunger injection, gravity feed, siphon feed, aspirators, unit dose, for example using a water soluble packet such as polyvinyl alcohol or a foil pouch, evacuation from a pressurized chamber, or diffusion through a membrane or permeable surface. If the composition is a gel or a thick liquid, it may be dispensed using a pump such as a peristaltic or bellows pump, syringe/plunger injection, caulk gun, unit dose, for example, using a water soluble packet such as polyvinyl alcohol or a foil pouch, evacuation from a pressurized chamber, or diffusion through a membrane or permeable surface. Finally, if the composition is a solid or powder, the composition may be dispensed using a spray, flood, auger, shaker, tablet-type dispenser, unit dose using a water soluble packet such as polyvinyl alcohol or foil pouch, or diffusion through a membrane or permeable surface. The dispenser may also be a dual dispenser in which the alkaline cleaning agent is dispensed on one side, and the acidic cleaning agent is dispensed on the other side. These dispensers may be located in the dish machine, outside of the dish machine, or remote from the dish machine. Finally, a single dispenser may feed one or more dish machines.

It is understood that the dish machines described herein may be used in conjunction with the disclosed methods. Additionally, the dish machines may be modified as described and used with a different method of cleaning For example, instead of using the methods in a modified dish machine, a different detergent, for example, a special surfactant package, rinse aid, or the like, may be run through the modified dish machine, for example through the additional wash or rinse arms, or spray nozzles.

Compositions

In aspects of the invention, the method includes using concentrated warewashing compositions. In some embodiments, the concentrated compositions include alkaline, acidic, or alkaline and acidic compositions. In some embodiments, the alkaline and acidic compositions alternate in either an alkaline-acid-alkaline or acid-alkaline-acid pattern, or the like.

As described, the methods include applying at least one concentrated composition directly to an article in a dishmachine for enhanced soil removal and reduced overall consumption of the chemistries. The other compositions can also be applied as concentrates directly to the article, or they can be diluted or applied through the sump.

As used herein, a "concentrate" refers to a composition with a high concentration of active ingredients. In the present disclosure, the "concentrate" can still be diluted and considered "concentrated" or an intermediate concentration solution. For example, it may be desirable to produce a concentrate as a solid block, powder or granulate. But, in order to apply the concentrate to the article, a portion of the solid may first need to be dissolved with a solvent like water to form a solution, where the intermediate concentration solution is then sprayed onto the article. In this example, the concentration of active ingredients in this intermediate concentration solution is still higher than the concentration of actives in the sump. That is, the intermediate concentration cleaning composition can have a concentration of at least about 2 times, at least about 3 times, at least about 20 times, at least about 100 times, at least about 200 times, or at least about 400 times the concentration of the use composition.

In an aspect, the intermediate concentration cleaning composition can have a concentration of active ingredients less than the concentration found in the concentrate produced by the manufacturer and/or shipped to the site of use. For example, the intermediate concentration cleaning composition can include a concentration of about 80 wt-%, about 50 wt-%, about 40 wt-%, about 20 wt-%, about 10 wt-%, about 5 wt-%, about 1 wt-%, or about 0.5 wt-%. In an embodiment, the intermediate concentration cleaning composition can include 100 wt-% of the concentrate. In some embodiments, the intermediate concentration refers to a solution that has at least 0.3 wt-% to about 80 wt-%, about 0.5 wt-% to about 60 wt-%, or about 1.5 wt-% to about 50 wt-% of active ingredients during contact with an article in the dishmachine.

In contrast, as used herein, a diluted composition refers to a composition with less than about 0.3 wt-%, less than about 0.1 wt-%, or less than about 0.03 wt-% of active ingredients.

Exemplary concentrated alkaline and acidic compositions may include some or all of the following materials shown in Table 1:

TABLE 1

| Concentrated Alkaline Compositions | | | |
|---|---|---|---|
| source of alkalinity | 1-90 wt-% | 20-85 wt-% | 40-80 wt-% |
| surfactant | 0-10 wt-% | 0.5-8 wt-% | 1-6 wt-% |
| chelating agent | 0-30 wt-% | 5-20 wt-% | 7-10 wt-% |
| bleaching agent | 0-60 wt-% | 0.5-40 wt-% | 1-20 wt-% |
| Catalyst | 0.001-3 wt-% | 0.002-1 wt-% | 0.01-0.4 wt-% |
| Enzyme | 0-6 wt-% | 0.05-4 wt-% | 0.1-2 wt-% |
| thickener | 0-20 wt-% | 0.1-10 wt-% | 0.5-5 wt-% |
| solidification agent | as needed | as needed | as needed |
| Water | balance | balance | balance |
| Concentrated Acidic Compositions | | | |
| Acid | 1-90 wt-% | 20-85 wt-% | 30-80 wt-% |
| surfactant | 0-10 wt-% | 0.5-8 wt-% | 1-5 wt-% |
| chelating agent | 0-50 wt-% | 2.5-30 wt-% | 5-20 wt-% |
| sanitizer | 0-6 wt-% | 0.05-4 wt-% | 0.1-2 wt-% |
| bleaching agent | 0-6 wt-% | 0.05-4 wt-% | 0.1-2 wt-% |
| anti-corrosion agent | 0-5 wt-% | 0.5-4 wt-% | 1-3 wt-% |
| catalyst | 0.001-3 wt-% | 0.002-1 wt-% | 0.01-0.4 wt-% |
| thickener | 0-20 wt-% | 0.1-10 wt-% | 0.5-5 wt-% |
| solidification agent | as needed | as needed | as needed |
| water | balance | balance | balance |

The concentrated compositions may be a liquid, thickened liquid, gelled liquid, paste, granular or pelletized solid material, solid block, cast solid block, powder, tablet, or the like. Liquid compositions can typically be made by forming the ingredients in an aqueous liquid or solvent system. Such systems are typically made by dissolving or suspending the active ingredients in water or in compatible solvent and then diluting the product to an appropriate concentration, either to form a concentrate or a use solution thereof. Gelled compositions can be made similarly by dissolving or suspending the active ingredients in a compatible solvent including a gelling agent at an appropriate concentration. Solid particulate materials can be made by blending the dry solid ingredients in appropriate ratios or agglomerating the material in appropriate agglomeration systems. Pelletized materials can be manufactured by compressing the solid granule or agglomerated materials in appropriate pelletizing equipment to result in appropriately sized pelletized materials. Solid block and cast solid block materials can be made by introducing into a container either a pre-hardened block of material or a castable liquid that hardens into a solid block within a container.

The composition may be provided in bulk or in unit dose. For example, the compositions may be provided in a large solid block that may be used for many cleaning cycles. Alternatively, the composition may be provided in unit dose form wherein a new composition is provided for each new cleaning cycle. In a preferred aspect the concentrated composition is a solid block composition.

The compositions may be packaged in a variety of materials, including a water soluble film, disposable plastic container, flexible bag, shrink wrap and the like. Further, the compositions may be packaged in such a way as to allow for multiple forms of product in one package, for example, a liquid and a solid in one unit dose package.

The compositions may be provided or packaged separately or together. For example, the alkaline composition may be provided and packaged completely separate from the acidic composition. Alternatively the alkaline, acidic, and other compositions like rinse compositions may be provided together in one package. For example, the alkaline, acidic and rinse compositions may be provided in a layered block or tablet wherein the first layer is the first alkaline composition, the second layer is the first acidic composition and the third layer is the second alkaline composition and optionally, the fourth layer is the rinse composition. It is understood that this layered arrangement may be adjusted to provide for more alkaline and acidic steps as contemplated by the disclosure or to include additional rinses or no rinses. The individual layers preferably have different characteristics that allow them to dissolve at the appropriate time. For example, the individual layers may dissolve at different temperatures that correspond to different wash cycles; the layer may take a certain amount of time to dissolve so that they dissolve at the appropriate time during the wash cycle; or the layers may be divided by a physical barrier that allows them to dissolve at the appropriate time, such as a paraffin layer, a water soluble film or a chemical coating.

In addition to providing the alkaline and acidic compositions in layers, the alkaline and acidic compositions may also be in separate domains. For example, the alkaline and acidic compositions may be in separate domains in a solid composition wherein each domain is dissolved by a separate spray when the particular composition is desired.

Alkaline Compositions

The disclosed methods include an alkaline composition wherein a concentrated alkaline composition is brought directly into contact with an article to be cleaned during the alkaline step of the cleaning process. The alkaline composition may be concentrated or diluted, but the method preferably applies at least one concentrated alkaline composition to the article to be cleaned. The alkaline composition includes one or more alkaline sources. Some non-limiting examples of suitable alkaline sources include the following: a hydroxide such as sodium hydroxide, or potassium hydroxide; an alkali silicate; an ethanolamine such as triethanolamine, diethanolamine, and monoethanolamine; an alkali carbonate; and mixtures thereof. The alkaline source is preferably a hydroxide or a mixture of hydroxides, or an alkali carbonate. Exemplary concentration ranges for the materials in the concentrated composition are described in Table 1.

In an aspect, when the concentrated alkaline composition is diluted, the alkaline source is preferably present in the diluted alkaline composition from about 125 ppm to about 5000 ppm, from about 250 ppm to about 3000 ppm, or from about 500 ppm to about 2000 ppm. The diluted alkaline composition may have a pH from about 7 to about 14, from about 9 to about 13, and from about 10 to about 12. The method may include multiple alkaline steps. The alkaline compositions may be the same or different compositions. Likewise, they may be different concentrations of the same composition.

The alkaline composition may include additional ingredients. For example, the alkaline composition may include water conditioning agent, an enzyme, a surfactant, a binding agent, an antimicrobial agent, a bleaching agent, a catalyst, a defoaming agent/foam inhibitor, a solidification agent, a thickener, an antiredeposition agent, a dye or odorant, a carrier, a hydrotrope and mixtures thereof.

Water Conditioning Agent

The alkaline composition may optionally include a water conditioning agent. The water conditioning agent can be referred to as a detergent builder or chelating agent and generally provides cleaning properties and chelating properties. Exemplary detergent builders include sodium sulphate, sodium chloride, starch, sugars, $C_1$-$C_{10}$ alkylene glycols such as propylene glycol, and the like. Exemplary chelating agents include phosphates, phosphonates, and amino-acetates. Exemplary phosphates include sodium orthophosphate, potassium orthophosphate, sodium pyrophosphate, potassium pyrophosphate, sodium tripolyphosphate (STPP), and sodium hexametaphosphate. Exemplary phosphonates include 1-hydroxyethane-1,1-diphosphonic acid, aminotrimethylene phosphonic acid, diethylenetriaminepenta(methylenephosphonic acid), 1-hydroxyethane-1,1-diphosphonic acid $CH._3C(OH)[PO(OH)_2]_2$, aminotri(methylenephosphonic acid) $N[CH_2PO(OH)2]_3$, aminotri(methylenephosphonate), sodium salt 2-hydroxyethyliminobis(methylenephosphonic acid) $HOCH_2CH_2N[CH_2PO(OH)_2]_2$, diethylenetriaminepenta(-methylenephosphonic acid) $(HO)_2POCH_2N[CH_2CH_2N[CH_2PO(OH)_2]_2]_2$, diethylenetriaminepenta(methylenephosphonate), sodium salt $C_9H_{(28-x)}N_3Na_xO_{15}P_5$ (x=7), hexamethylenediamine(tetramethylenephosphonate), potassium salt $C_{10}H_{(28-x)}N_2K_xO_{12}P_4$ (x=6), bis(hexamethylene)triamine(pentamethylenephosphonic acid) $(HO_2)POCH_2N[(CH_2)_6N[CH_2PO(OH)_2]_2]_2$, and phosphorus acid $H_3PO_3$. Exemplary amino-acetates include aminocarboxylic acids such as N-hydroxyethyliminodiacetic acid, nitrilotriacetic acid (NTA), ethylenediaminetetraacetic acid (EDTA), N-hydroxyethyl-ethylenediaminetriacetic acid (HEDTA), and diethylenetriaminepentaacetic acid (DTPA).

Enzymes

The alkaline composition may optionally include one or more enzymes, which can provide desirable activity for removal of protein-based, carbohydrate-based, or triglyceride-based soils from substrates such as flatware, cups and bowls, and pots and pans. Enzymes can act by degrading or altering one or more types of soil residues encountered on a surface thus removing the soil or making the soil more removable. Both degradation and alteration of soil residues can improve detergency by reducing the physicochemical forces which bind the soil to the surface being cleaned, i.e. the soil becomes more water soluble. For example, one or more proteases can cleave complex, macromolecular protein structures present in soil residues into simpler short chain molecules which are, of themselves, more readily desorbed from surfaces, solubilized, or otherwise more easily removed by detersive solutions containing said proteases.

Suitable enzymes include a protease, an amylase, a lipase, a gluconase, a cellulase, a peroxidase, or a mixture thereof of any suitable origin, such as vegetable, animal, bacterial, fungal or yeast origin. Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases. Preferably the enzyme is a protease, a lipase, an amylase, or a combination thereof.

A valuable reference on enzymes is "Industrial Enzymes," Scott, D., in Kirk-Othmer Encyclopedia of Chemical Technology, 3rd Edition, (editors Grayson, M. and EcKroth, D.) Vol. 9, pp. 173-224, John Wiley & Sons, New York, 1980, which is incorporated herein by its entirety.

Protease

A protease can be derived from a plant, an animal, or a microorganism. Preferably the protease is derived from a microorganism, such as a yeast, a mold, or a bacterium. Preferred proteases include serine proteases active at alkaline pH, preferably derived from a strain of *Bacillus* such as *Bacillus subtilis* or *Bacillus licheniformis*; these preferred proteases include native and recombinant subtilisins. The protease can be purified or a component of a microbial extract, and either wild type or variant (either chemical or recombinant). Examples of proteolytic enzymes include (with trade names) Savinase®; a protease derived from *Bacillus lentus* type, such as Maxacal®, Opticlean®, Durazym®, and Properase®; a protease derived from *Bacillus licheniformis*, such as Alcalase® and Maxatase®; and a protease derived from *Bacillus amyloliquefaciens*, such as Primase®. Commercially available protease enzymes include those sold under the trade names Alcalase®, Savinase®, Primase®, Durazym®, or Esperase® by Novo Industries A/S (Denmark); those sold under the trade names Maxatase®, Maxacal®, or Maxapem® by Gist-Brocades (Netherlands); those sold under the trade names Purafect®, Purafect OX, and Properase by Genencor International; those sold under the trade names Opticlean® or Optimase® by Solvay Enzymes; and the like. A mixture of such proteases can also be used. For example, Purafect® is an alkaline protease (a subtilisin) having application in lower temperature cleaning programs, from about 30° C. to about 65° C.; whereas, Esperase® is an alkaline protease of choice for higher temperature detersive solutions, from about 50° C. to about 85° C. Detersive proteases are described in patent publications, which are incorporated herein by reference in its entirety, including: GB 1,243,784, WO 9203529 A (enzyme/inhibitor system), WO 9318140 A, and WO 9425583 (recombinant trypsin-like protease) to Novo; WO 9510591 A, WO 9507791 (a protease having decreased adsorption and increased hydrolysis), WO 95/30010, WO 95/30011, WO 95/29979, to Procter & Gamble; WO 95/10615 (*Bacillus amyloliquefaciens* subtilisin) to Genencor International; EP 130,756 A (protease A); EP 303,761 A (protease B); and EP 130,756 A. A variant protease is preferably at least 80% homologous, preferably having at least 80% sequence identity, with the amino acid sequences of the proteases in these references.

Naturally, mixtures of different proteolytic enzymes may be used. While various specific enzymes have been described above, it is understood that any protease which can confer the desired proteolytic activity to the composition may be used.

Amylase

An amylase can be derived from a plant, an animal, or a microorganism. Preferably the amylase is derived from a microorganism, such as a yeast, a mold, or a bacterium. Amylases include those derived from a *Bacillus*, such as *B. licheniformis, B. amyloliquefaciens, B. subtilis*, or *B. stearothermophilus*. The amylase can be purified or a component of a microbial extract, and either wild type or variant (either chemical or recombinant), preferably a variant that is more stable under washing or presoak conditions than a wild type amylase.

Examples of amylase enzymes include those sold under the trade name Rapidase by Gist-Brocades® (Netherlands); those sold under the trade names Termamyl®, Fungamyl® or Duramyl® by Novo; Purastar STL or Purastar OXAM by Genencor; and the like. Preferred commercially available amylase enzymes include the stability enhanced variant amylase sold under the trade name Duramyl® by Novo. A mixture of amylases can also be used.

Suitable amylases include: I-amylases described in WO 95/26397, PCT/DK96/00056, and GB 1,296,839 to Novo; and stability enhanced amylases described in J. Biol. Chem., 260(11):6518-6521 (1985); WO 9510603 A, WO 9509909 A and WO 9402597 to Novo; references disclosed in WO 9402597; and WO 9418314 to Genencor International. Each of these references are herein incorporated by reference in their entirety. A variant I-amylase is preferably at least 80% homologous, preferably having at least 80% sequence identity, with the amino acid sequences of the proteins of these references.

Naturally, mixtures of different amylase enzymes can be used. While various specific enzymes have been described above, it is understood that any amylase which can confer the desired amylase activity to the composition can be used.

Cellulases

A suitable cellulase can be derived from a plant, an animal, or a microorganism. Preferably the cellulase is derived from a microorganism, such as a fungus or a bacterium. Cellulases include those derived from a fungus, such as *Humicola insolens, Humicola* strain DSM1800, or a cellulase 212-producing fungus belonging to the genus *Aeromonas* and those extracted from the hepatopancreas of a marine mollusk, *Dolabella Auricula Solander*. The cellulase can be purified or a component of an extract, and either wild type or variant (either chemical or recombinant).

Examples of cellulase enzymes include those sold under the trade names Carezyme® or Celluzyme® by Novo, or Cellulase by Genencor; and the like. A mixture of cellulases can also be used. Suitable cellulases are described in patent documents, which are herein incorporated by reference in their entirety, including: U.S. Pat. No. 4,435,307, GB-A-2.075.028, GB-A-2.095.275, DE-OS-2.247.832, WO 9117243, and WO 9414951 A (stabilized cellulases) to Novo.

Naturally, mixtures of different cellulase enzymes can be used. While various specific enzymes have been described above, it is to be understood that any cellulase which can confer the desired cellulase activity to the composition can be used.

Lipases

A suitable lipase can be derived from a plant, an animal, or a microorganism. Preferably the lipase is derived from a microorganism, such as a fungus or a bacterium. Preferred lipases include those derived from a *Pseudomonas*, such as *Pseudomonas stutzeri* ATCC 19.154, or from a *Humicola*, such as *Humicola lanuginosa* (typically produced recombinantly in *Aspergillus oryzae*). The lipase can be purified or a component of an extract, and either wild type or variant (either chemical or recombinant).

Examples of lipase enzymes that can be used include those sold under the trade names Lipase P "Amano" or "Amano-P" by Amano Pharmaceutical Co. Ltd., Nagoya, Japan or under the trade name Lipolase® by Novo, and the like. Other commercially available lipases that can be used include Amano-CES, lipases derived from *Chromobacter viscosum*, e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., and lipases derived from *Pseudomonas gladioli* or from *Humicola lanuginosa*.

A preferred lipase is sold under the trade name Lipolase® by Novo. Suitable lipases are described in patent documents, which are herein incorporated by reference in their entirety, including: WO 9414951 A (stabilized lipases) to Novo, WO 9205249, RD 94359044, GB 1,372,034, Japanese Patent Application 53,20487, laid open Feb. 24, 1978 to Amano Pharmaceutical Co. Ltd., and EP 341,947.

Naturally, mixtures of different lipase enzymes can be used. While various specific enzymes have been described above, it is to be understood that any lipase which can confer the desired lipase activity to the composition can be used.

Additional Enzymes

Additional suitable enzymes include a cutinase, a peroxidase, a gluconase, and the like. Suitable cutinase enzymes are described in WO 8809367 A to Genencor. Known peroxidases include horseradish peroxidase, ligninase, and haloperoxidases such as chloro- or bromo-peroxidase. Suitable peroxidases are disclosed in WO 89099813 A and WO 8909813 A to Novo. Peroxidase enzymes can be used in combination with oxygen sources, e.g., percarbonate, perborate, hydrogen peroxide, and the like. Additional enzymes are disclosed in WO 9307263 A and WO 9307260 A to Genencor International, WO 8908694 A to Novo, and U.S. Pat. No. 3,553,139 to McCarty et al., U.S. Pat. No. 4,101,457 to Place et al., U.S. Pat. No. 4,507,219 to Hughes and U.S. Pat. No. 4,261,868 to Hora et al. Each of these references are herein incorporated by reference in their entirety.

An additional enzyme, such as a cutinase or peroxidase, can be derived from a plant, an animal, or a microorganism. Preferably the enzyme is derived from a microorganism. The enzyme can be purified or a component of an extract, and either wild type or variant (either chemical or recombinant).

Naturally, mixtures of different additional enzymes can be incorporated into this invention. While various specific enzymes have been described above, it is to be understood that any additional enzyme which can confer the desired enzyme activity to the composition can be used.

Surfactant

The alkaline composition may optionally include a surfactant. The surfactant or surfactant mixture can be selected from water soluble or water dispersible nonionic, semi-polar nonionic, anionic, cationic, amphoteric, or zwitterionic surface-active agents; or any combination thereof.

A typical listing of the classes and species of surfactants useful herein appears in U.S. Pat. No. 3,664,961, which is herein incorporated by reference in its entirety.

Nonionic Surfactants

Nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Useful nonionic surfactants include:

1. Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available under the trade names Pluronic® and Tetronic® manufactured by BASF Corp.

Pluronic® compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from 1,000 to 4,000. Ethylene oxide is then added to sandwich this hydrophobe between hydrophilic groups, controlled by length to constitute from about 10% by weight to about 80% by weight of the final molecule.

Tetronic® compounds are tetra-functional block copolymers derived from the sequential addition of propylene oxide and ethylene oxide to ethylenediamine. The molecular weight of the propylene oxide hydrotype ranges from 500 to 7,000; and, the hydrophile, ethylene oxide, is added to constitute from 10% by weight to 80% by weight of the molecule.

2. Condensation products of one mole of alkyl phenol wherein the alkyl chain, of straight chain or branched chain configuration, or of single or dual alkyl constituent, contains from 8 to 18 carbon atoms with from 3 to 50 moles of ethylene oxide. The alkyl group can, for example, be represented by diisobutylene, di-amyl, polymerized propylene, iso-octyl, nonyl, and di-nonyl. These surfactants can be polyethylene, polypropylene, and polybutylene oxide condensates of alkyl phenols. Examples of commercial compounds of this chemistry are available on the market under the trade names Igepal® manufactured by Rhone-Poulenc and Triton® manufactured by Union Carbide.

3. Condensation products of one mole of a saturated or unsaturated, straight or branched chain alcohol having from 6 to 24 carbon atoms with from 3 to 50 moles of ethylene oxide. The alcohol moiety can consist of mixtures of alcohols in the above delineated carbon range or it can consist of an alcohol having a specific number of carbon atoms within this range. Commercially available surfactants include the trade names Neodol® manufactured by Shell Chemical Co. and Alfonic® manufactured by Vista Chemical Co.

4. Condensation products of one mole of saturated or unsaturated, straight or branched chain carboxylic acid having from 8 to 18 carbon atoms with from 6 to 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Nopalcol® manufactured by Henkel Corporation and Lipopeg® manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols can be used. All of these ester moieties have one or more reactive hydrogen sites on their molecule which can undergo further acylation or ethylene oxide (alkoxide) addition to control the hydrophilicity of these substances. Care must be exercised when adding these fatty ester or acylated carbohydrates to compositions containing amylase and/or lipase enzymes because of potential incompatibility.

Examples of nonionic low foaming surfactants include:

5. Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from 1,000 to 3,100 with the central hydrophile including 10% by weight to 80% by weight of the final molecule. These reverse Pluronics® are manufactured by BASF Corporation under the trade name Pluronic® R surfactants.

Likewise, the Tetronic® R surfactants are produced by BASF Corporation by the sequential addition of ethylene oxide and propylene oxide to ethylenediamine. The hydrophobic portion of the molecule weighs from 2,100 to 6,700 with the central hydrophile including 10% by weight to 80% by weight of the final molecule.

6. Compounds from groups (1), (2), (3) and (4) which are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Additional examples of effective low foaming nonionics include:

7. The alkylphenoxypolyethoxyalkanols of U.S. Pat. No. 2,903,486 issued Sep. 8, 1959 to Brown et al. and represented by the formula

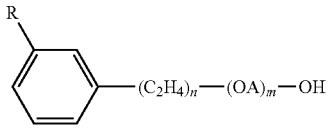

in which R is an alkyl group of 8 to 9 carbon atoms, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. having the general formula $Z[(OR)_nOH]_z$ wherein Z is alkoxylatable material, R is a radical derived from an alkaline oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al. corresponding to the formula $Y(C_3H_6O)_n(C_2H_4O)_mH$ wherein Y is the residue of organic compound having from 1 to 6 carbon atoms and one reactive hydrogen atom, n has an average value of at least 6.4, as determined by hydroxyl number and m has a value such that the oxyethylene portion constitutes 10% to 90% by weight of the molecule.

The conjugated polyoxyalkylene compounds described in U.S. Pat. No. 2,674,619, issued Apr. 6, 1954 to Lundsted et al. having the formula $Y[(C_3H_6O_n(C_2H_4O)_mH]_x$ wherein Y is the residue of an organic compound having from 2 to 6 carbon atoms and containing x reactive hydrogen atoms in which x has a value of at least 2, n has a value such that the molecular weight of the polyoxypropylene hydrophobic base is at least 900 and m has value such that the oxyethylene content of the molecule is from 10% to 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents correspond to the formula: $P[(C_3H_6O)_n(C_2H_4O)_mH]_x$ wherein P is the residue of an organic compound having from 8 to 18 carbon atoms and containing x reactive hydrogen atoms in which x has a value of 1 or 2, n has a value such that the molecular weight of the polyoxyethylene portion is at least 44 and m has a value such that the oxypropylene content of the molecule is from 10% to 90% by weight. In either case the oxypropylene chains may contain optionally, but advantageously, small amounts of ethylene oxide and the oxyethylene chains may contain also optionally, but advantageously, small amounts of propylene oxide.

8. Polyhydroxy fatty acid amide surfactants include those having the structural formula $R^2CONR^1Z$ in which: $R^1$ is H, $C_1$-$C_4$ hydrocarbyl, 2-hydroxy ethyl, 2-hydroxy propyl, ethoxy, propoxy group, or a mixture thereof; $R^2$ is a $C_5$-$C_{31}$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycityl moiety.

9. The alkyl ethoxylate condensation products of aliphatic alcohols with from 0 to 25 moles of ethylene oxide may be used. The alkyl chain of the aliphatic alcohol can either be straight or branched, primary or secondary, and generally contains from 6 to 22 carbon atoms.

10. The ethoxylated $C_6$-$C_{18}$ fatty alcohols and $C_6$-$C_{18}$ mixed ethoxylated and propoxylated fatty alcohols may be used, particularly those that are water soluble. Ethoxylated fatty alcohols include the $C_{10}$-$C_{18}$ ethoxylated fatty alcohols with a degree of ethoxylation of from 3 to 50.

11. Suitable nonionic alkylpolysaccharide surfactants include those disclosed in U.S. Pat. No. 4,565,647. These surfactants include a hydrophobic group containing from 6 to 30 carbon atoms and a polysaccharide, e.g., a polyglycoside, hydrophilic group containing from 1.3 to 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

12. Fatty acid amide surfactants include those having the formula: $R^6CON(R^7)_2$ in which $R^6$ is an alkyl group containing from 7 to 21 carbon atoms and each $R^7$ is independently hydrogen, $C_1$-$C_4$ alkyl, $C_1$-$C_4$ hydroxyalkyl, or $—(C_2H_4O)_xH$, where x is in the range of from 1 to 3.

13. A useful class of non-ionic surfactants includes the class defined as alkoxylated amines or, most particularly, alcohol alkoxylated/aminated/alkoxylated surfactants. These non-ionic surfactants may be at least in part represented by the general formulae:

$$R^{20}\text{-}(PO)_sN\text{-}(EO)_tH,$$

$$R^{20}\text{-}(PO)_sN\text{-}(EO)_tH(EO)_uH, \text{ and}$$

$$R^{20}\text{-}N(EO)_tH;$$

in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula:

$$R^{20}\text{-}(PO)_v\text{-}N[(EO)_wH][(EO)_zH]$$

in which $R^{20}$ is as defined above, v is 1 to 20 (e.g., 1, 2, 3, or 4 (preferably 2)), and w and z are independently 1-10, preferably 2-5.

These compounds are represented commercially by a line of products sold by Huntsman Chemicals as nonionic surfactants. A preferred chemical of this class includes Surfonic™ PEA 25 Amine Alkoxylate.

The treatise Nonionic Surfactants, edited by Schick, M. J., Vol. 1 of the Surfactant Science Series, Marcel Dekker, Inc., New York, 1983 is an excellent reference on the wide variety of nonionic compounds generally employed in the practice of the present invention. A typical listing of nonionic classes, and species of these surfactants, is given in U.S. Pat. No. 3,929. Further examples are given in "Surface Active Agents and Detergents" (Vol. I and II by Schwartz, Perry and Berch). Each of these references are herein incorporated by reference in their entirety.

Semi-Polar Nonionic Surfactants

The semi-polar type of nonionic surface active agents are another class of nonionic surfactant. The semi-polar nonionic surfactants include the amine oxides, phosphine oxides, sulfoxides and their alkoxylated derivatives.

14. Amine oxides are tertiary amine oxides corresponding to the general formula:

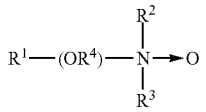

wherein the arrow is a conventional representation of a semi-polar bond; and $R^1$, $R^2$, and $R^3$ may be aliphatic, aromatic, heterocyclic, alicyclic, or combinations thereof. Generally, for amine oxides of detergent interest, $R^1$ is an alkyl radical of from 8 to 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkaline or a hydroxyalkylene group containing 2 to 3 carbon atoms; and n ranges from 0 to 20.

Useful water soluble amine oxide surfactants are selected from the coconut or tallow alkyl di-(lower alkyl) amine oxides, specific examples of which are dodecyldimethylamine oxide, tridecyldimethylamine oxide, tetradecyldimethylamine oxide, pentadecyldimethylamine oxide, hexadecyldimethylamine oxide, heptadecyldimethylamine oxide, octadecyldimethylamine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Useful semi-polar nonionic surfactants also include the water soluble phosphine oxides having the following structure:

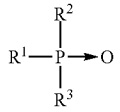

wherein the arrow is a conventional representation of a semi-polar bond; and $R^1$ is an alkyl, alkenyl or hydroxyalkyl moiety ranging from 10 to 24 carbon atoms in chain length; and $R^2$ and $R^3$ are each alkyl moieties separately selected from alkyl or hydroxyalkyl groups containing 1 to 3 carbon atoms.

Examples of useful phosphine oxides include dimethyldecylphosphine oxide, dimethyltetradecylphosphine oxide, methylethyltetradecylphosphine oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide.

Semi-polar nonionic surfactants also include the water soluble sulfoxide compounds which have the structure:

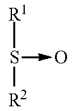

wherein the arrow is a conventional representation of a semi-polar bond; and, $R^1$ is an alkyl or hydroxyalkyl moiety of 8 to 28 carbon atoms, from 0 to 5 ether linkages and from 0 to 2 hydroxyl substituents; and $R^2$ is an alkyl moiety consisting of alkyl and hydroxyalkyl groups having 1 to 3 carbon atoms.

Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Anionic Surfactants

Anionic surfactants are categorized as anionics because the charge on the hydrophobe is negative or because the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility.

Anionics are excellent detersive surfactants and are therefore favored additions to heavy duty detergent compositions. Generally, however, anionics have high foam profiles which limit their use alone or at high concentration levels in cleaning systems that require strict foam control. Anionic surface active compounds are useful to impart special chemical or physical properties other than detergency within the composition. Anionics can be employed as gelling agents or as part of a gelling or thickening system. Anionics are excellent solubilizers and can be used for hydrotropic effect and cloud point control.

The majority of large volume commercial anionic surfactants can be subdivided into five major chemical classes and additional sub-groups known to those of skill in the art and described in "Surfactant Encyclopedia," Cosmetics & Toiletries, Vol. 104 (2) 71-86 (1989). The first class includes acylamino acids (and salts), such as acylgluamates, acyl peptides, sarcosinates (e.g. N-acyl sarcosinates), taurates (e.g. N-acyl taurates and fatty acid amides of methyl tauride), and the like. The second class includes carboxylic acids (and salts), such as alkanoic acids (and alkanoates), ester Scarboxylic acids (e.g. alkyl succinates), ether carboxylic acids, and the like. The third class includes phosphoric acid esters and their salts. The fourth class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. The fifth class includes sulfuric acid esters (and salts), such as alkyl ether sulfates, alkyl sulfates, and the like.

Suitable anionic sulfate surfactants include the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides such as the sulfates of alkylpolyglucoside (the nonionic nonsulfated compounds being described herein).

Examples of suitable synthetic, water soluble anionic detergent compounds include the ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from 5 to 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives.

Suitable anionic carboxylate surfactants include the alkyl ethoxy carboxylates, the alkyl polyethoxy polycarboxylate surfactants and the soaps (e.g. alkyl carboxyls). Secondary soap surfactants (e.g. alkyl carboxyl surfactants) include those which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present.

Other anionic detergents include olefin sulfonates, such as long chain alkene sulfonates, long chain hydroxyalkane sulfonates or mixtures of alkenesulfonates and hydroxyalkanesulfonates. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule). Resin acids and hydrogenated resin acids are also suitable, such as rosin, hydrogenated rosin, and resin acids and hydrogenated resin acids present in or derived from tallow oil.

The particular salts will be suitably selected depending upon the particular formulation and the needs therein.

Further examples of suitable anionic surfactants are given in "Surface Active Agents and Detergents" (Vol. I and II by Schwartz, Perry and Berch). A variety of such surfactants are also generally disclosed in U.S. Pat. No. 3,929,678, which is herein incorporated by reference in its entirety.

Cationic Surfactants

Cationic surfactants are classified as cationic if the charge on the hydrotrope portion of the molecule is positive. Surfactants in which the hydrotrope carries no charge unless the pH is lowered close to neutrality or lower, but which are then cationic (e.g. alkyl amines), are also included in this group. In theory, cationic surfactants may be synthesized from any combination of elements containing an "onium" structure RnX+Y− and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, which can make them less expensive.

Cationic surfactants preferably include compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The simplest cationic amines, amine salts and quaternary ammonium compounds can be schematically drawn thus:

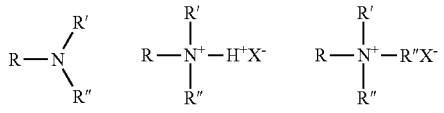

in which, R represents a long alkyl chain, R', R", and R"' may be either long alkyl chains or smaller alkyl or aryl groups or hydrogen and X represents an anion. The amine salts and quaternary ammonium compounds are preferred for practical use in this invention due to their high degree of water solubility.

The majority of large volume commercial cationic surfactants can be subdivided into four major classes and additional sub-groups known to those of skill in the art and described in "Surfactant Encyclopedia," Cosmetics & Toiletries, Vol. 104 (2) 86-96 (1989). The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions. These desirable properties can include detergency in compositions of or below neutral pH, antimicrobial efficacy, thickening or gelling in cooperation with other agents, and the like.

Useful cationic surfactants include those having the formula $R^1{}_mR^2{}_xY_LZ$ wherein each $R^1$ is an organic group containing a straight or branched alkyl or alkenyl group optionally substituted with up to three phenyl or hydroxy groups and optionally interrupted by up to four of the following structures:

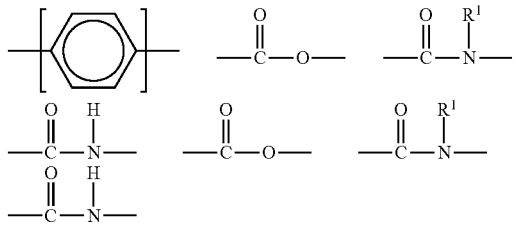

or an isomer or mixture of these structures, and which contains from 8 to 22 carbon atoms. The $R^1$ groups can additionally contain up to 12 ethoxy groups. m is a number from 1 to 3. Preferably, no more than one $R^1$ group in a molecule has 16 or more carbon atoms when m is 2, or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, preferably from 0 to 6. The remainder of any carbon atom positions on the Y group are filled by hydrogens.

Y can be a group including, but not limited to:

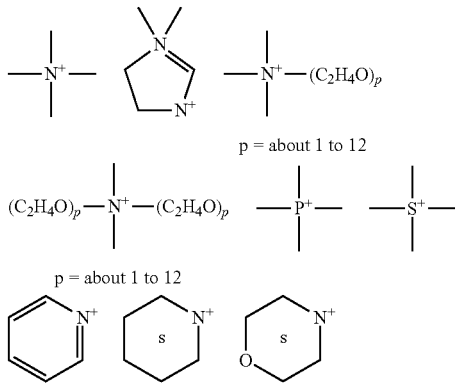

or a mixture thereof. Preferably, L is 1 or 2, with the Y groups being separated by a moiety selected from $R^1$ and $R^2$ analogs (preferably alkylene or alkenylene) having from 1 to 22 carbon atoms and two free carbon single bonds when L is 2. Z is a water soluble anion, such as sulfate, methylsulfate, hydroxide, or nitrate anion, particularly preferred being sulfate or methyl sulfate anions, in a number to give electrical neutrality of the cationic component.

Amphoteric Surfactants

Amphoteric, or ampholytic, surfactants contain both a basic and an acidic hydrophilic group and an organic hydrophobic group. These ionic entities may be any of the anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia," Cosmetics & Toiletries, Vol. 104 (2) 69-71 (1989). The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with ethyl acetate. During alkylation, one or two carboxyalkyl groups react to form a tertiary amine and an ether linkage with differing alkylating agents yielding different tertiary amines.

Long chain imidazole derivatives generally have the general formula:

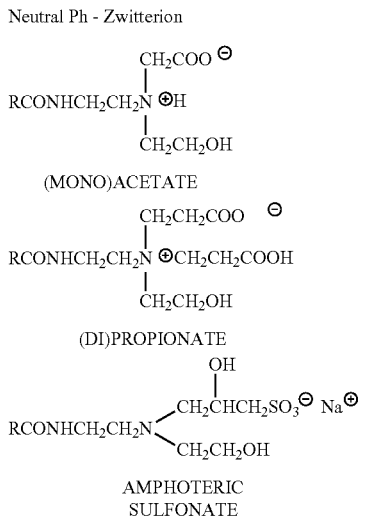

wherein R is an acyclic hydrophobic group containing from 8 to 18 carbon atoms and M is a cation to neutralize the charge of the anion, generally sodium. Commercially prominent imidazoline-derived amphoterics include for example: cocoamphopropionate, cocoamphocarboxy-propionate, cocoamphoglycinate, cocoamphocarboxy-glycinate, cocoamphopropyl-sulfonate, and cocoamphocarboxy-propionic acid. Preferred amphocarboxylic acids are produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reacting $RNH_2$, in which R═$C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine Examples of commercial N-alkylamino acid ampholytes include alkyl beta-amino dipropionates, $RN(C_2H_4COOM)_2$ and $RNHC_2H_4COOM$. In these, R is preferably an acyclic hydrophobic group containing from 8 to 18 carbon atoms, and M is a cation to neutralize the charge of the anion.

Preferred amphoteric surfactants include those derived from coconut products such as coconut oil or coconut fatty acid. The more preferred of these coconut derived surfactants include as part of their structure an ethylenediamine moiety, an alkanolamide moiety, an amino acid moiety, preferably glycine, or a combination thereof; and an aliphatic substituent of from 8 to 18 (preferably 12) carbon atoms. Such a surfactant can also be considered an alkyl amphodicarboxylic acid. Disodium cocoampho dipropionate is one most preferred amphoteric surfactant and is commercially available under the tradename Miranol™ FBS from Rhodia Inc., Cranbury, N.J. Another most preferred coconut derived amphoteric surfactant with the chemical name disodium cocoampho diacetate is sold under the tradename Miranol™ C2M-SF Conc., also from Rhodia Inc., Cranbury, N.J.

A typical listing of amphoteric classes, and species of these surfactants, is given in U.S. Pat. No. 3,929,678, which is herein incorporated by reference in its entirety.

Zwitterionic Surfactants

Zwitterionic surfactants can be thought of as a subset of the amphoteric surfactants. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion, a negative charged carboxyl group, and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate. Betaine and sultaine surfactants are exemplary zwitterionic surfactants for use herein.

A general formula for these compounds is:

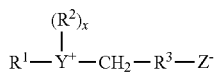

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propane-1-phosphonate; 3 -(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxylate; 3-[S-ethyl-S-(3-dodecoxy-2-hydroxypropyl)sulfonio]-propane-1-phosphate; 3 -[P,P-dimethyl-P-dodecylphosphonio]-propane-1-phosphonate; and S[N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

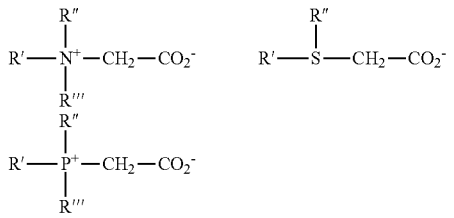

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines include those compounds having the formula $(R(R^1)_2\ N^+\ R^2SO^{3-}$, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678, which is herein incorporated by reference in its entirety.

Binding Agent

The alkaline composition may optionally include a binding agent to bind the detergent composition together to provide a solid detergent composition. The binding agent may be formed by mixing alkali metal carbonate, alkali metal bicarbonate, and water. The binding agent may also be urea or polyethylene glycol.

Antimicrobial Agent

The alkaline composition may optionally include an antimicrobial agent. Antimicrobial agents are chemical compositions that can be used in the composition to prevent microbial contamination and deterioration of commercial products material systems, surfaces, etc. Generally, these materials fall in specific classes including phenolics, halogen compounds, quaternary ammonium compounds, metal derivatives, amines, alkanol amines, nitro derivatives, analides, organosulfur and sulfur-nitrogen compounds and miscellaneous compounds. The given antimicrobial agent depending on chemical composition and concentration may simply limit further proliferation of numbers of the microbe or may destroy all or a substantial proportion of the microbial population. The terms "microbes" and "microorganisms" typically refer primarily to bacteria and fungus microorganisms. In use, the antimicrobial agents are formed into the final product that when diluted and dispensed using an aqueous stream forms an aqueous disinfectant or sanitizer composition that can be contacted with a variety of surfaces resulting in prevention of growth or the killing of a substantial proportion of the microbial population.

Common antimicrobial agents include phenolic antimicrobials such as pentachlorophenol, orthophenylphenol. Halogen containing antibacterial agents include sodium trichloroisocyanurate, sodium dichloroisocyanurate (anhydrous or dihydrate), iodine-poly(vinylpyrolidin-onen) complexes, bromine compounds such as 2-bromo-2-nitropropane-1,3-diol quaternary antimicrobial agents such as benzalconium chloride, cetylpyridiniumchloride, amine and nitro containing antimicrobial compositions such as hexahydro-1,3,5-tris (2-hydroxyethyl)-s-triazine, dithiocarbamates such as sodium dimethyldithiocarbamate, and a variety of other materials known in the art for their microbial properties. Antimicrobial agents may be encapsulated to improve stability and/or to reduce reactivity with other materials in the detergent composition.

Bleaching Agent

The alkaline composition may optionally include a bleaching agent. Bleaching agents for lightening or whitening a substrate include bleaching compounds capable of liberating an active halogen species, such as $Cl_2$, $Br_2$, —$OCl^-$ and/or —$OBr^-$, under conditions typically encountered during the cleansing process. Suitable bleaching agents include, for example, chlorine-containing compounds such as a chlorine, a hypochlorite, chloramine. Preferred halogen-releasing compounds include the alkali metal dichloroisocyanurates, chlorinated trisodium phosphate, the alkali metal hypochlorites, monochlorarrine and dichloramine, and the like. Encapsulated bleaching sources may also be used to enhance the stability of the bleaching source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. A cleaning composition may include a minor but effective amount of a bleaching agent, preferably about 0.1 wt-% to about 10 wt-%, preferably from about 1 wt-% to about 6 wt-%.

Catalyst

The alkaline compositions can optionally include a catalyst capable of reacting with another material used in the dishwashing machine. For example, in some embodiments, the alkaline composition can be used in a method of dishwashing where the method includes an acidic composition and an alkaline composition, and the alkaline composition includes a catalyst and the acidic composition includes something that the catalyst reacts with, such as an oxygen source, such that when the alkaline composition and the acidic composition interact inside of the dishwashing machine, they react. One reaction could be the production of oxygen gas in situ on and in soil located on an article to be cleaned inside of the dishmachine. The opposite could also be true, where the acidic composition includes a catalyst and the alkaline composition includes something that the catalyst reacts with such as a bleaching agent or oxygen source.

Exemplary catalysts include but are not limited to transition metal complexes, halogens, ethanolamines, carbonates and bicarbonates, iodide salts, hypochlorite salts, catalase enzymes, bisulfites, thiosulfate, and UV light. Exemplary transition metal complexes can be compositions that include a transition metal such as tin, lead, manganese, molybdenum, chromium, copper, iron, cobalt, and mixtures thereof. Exemplary halogens include fluorine, chlorine, bromine, and iodine.

Defoaming Agent/Foam Inhibitor

The alkaline composition may optionally include a defoaming agent or a foam inhibitor. A defoaming agent or foam inhibitor may be included for reducing the stability of any foam that is formed. Examples of foam inhibitors include silicon compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, polyoxyethylene-polyoxypropylene block copolymers, alkyl phosphate esters such as monostearyl phosphate and the like. A discussion of foam inhibitors may be found, for example, in U.S. Pat. Nos. 3,048,548, 3,334,147 and 3,442,242, the disclosures of which are herein incorporated by reference herein.

Antiredeposition Agent

The alkaline composition may optionally include an antiredeposition agent capable of facilitating sustained suspension of soils in a cleaning solution and preventing the removed soils from being redeposited onto the substrate being cleaned. Examples of suitable antiredeposition agents include fatty acid amides, complex phosphate esters, styrene maleic anhydride copolymers, and cellulosic derivatives such as hydroxyethyl cellulose, hydroxypropyl cellulose, and the like.

Dye or Odorant

Various dyes, odorants including perfumes, and other aesthetic enhancing agents may optionally be included in the alkaline composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included include, for example, terpenoids such as citronellol, aldehydes such as amyl cinnamaldehyde, a jasmine such as CIS-jasmine or jasmal, vanillin, and the like.

Hydrotrope

The alkaline composition may optionally include a hydrotrope, coupling agent, or solubilizer that aids in compositional stability, and aqueous formulation. Functionally speaking, the suitable couplers which can be employed are nontoxic and retain the active ingredients in aqueous solution throughout the temperature range and concentration to which a concentrate or any use solution is exposed.

Any hydrotrope coupler may be used provided it does not react with the other components of the composition or negatively affect the performance properties of the composition. Representative classes of hydrotropic coupling agents or solubilizers which can be employed include anionic surfactants such as alkyl sulfates and alkane sulfonates, linear alkyl benzene or naphthalene sulfonates, secondary alkane sulfonates, alkyl ether sulfates or sulfonates, alkyl phosphates or phosphonates, dialkyl sulfosuccinic acid esters, sugar esters (e.g., sorbitan esters), amine oxides (mono-, di-, or tri-alkyl) and $C_8$-$C_{10}$ alkyl glucosides. Preferred coupling agents include n-octanesulfonate, available as NAS 8D from Ecolab Inc., n-octyl dimethylamine oxide, and the commonly available aromatic sulfonates such as the alkyl benzene sulfonates (e.g. xylene sulfonates) or naphthalene sulfonates, aryl or alkaryl phosphate esters or their alkoxylated analogues having 1 to about 40 ethylene, propylene or butylene oxide units or mixtures thereof. Other preferred hydrotropes include nonionic surfactants of $C_6$-$C_{24}$ alcohol alkoxylates (alkoxylate means ethoxylates, propoxylates, butoxylates, and co-or-terpolymer mixtures thereof) (preferably $C_6$-$C_{14}$ alcohol alkoxylates) having 1 to about 15 alkylene oxide groups (preferably about 4 to about 10 alkylene oxide groups); $C_6$-$C_{24}$ alkylphenol alkoxylates (preferably $C_8$-$C_{10}$ alkylphenol alkoxylates) having 1 to about 15 alkylene oxide groups (preferably about 4 to about 10 alkylene oxide groups); $C_6$-$C_{24}$ alkylpolyglycosides (preferably $C_6$-$C_{20}$ alkylpolyglycosides) having 1 to about 15 glycoside groups (preferably about 4 to about 10 glycoside groups); $C_6$-$C_{24}$ fatty acid ester ethoxylates, propoxylates or glycerides; and $C_4$-$C_{12}$ mono or dialkanolamides.

Carrier

The alkaline composition may optionally include a carrier or solvent. The carrier may be water or other solvent such as an alcohol or polyol. Low molecular weight primary or secondary alcohols exemplified by methanol, ethanol, propanol, and isopropanol are suitable. Monohydric alcohols are preferred for solubilizing surfactant, but polyols such as those containing from about 2 to about 6 carbon atoms and from about 2 to about 6 hydroxy groups (e.g. propylene glycol, ethylene glycol, glycerine, and 1,2-propanediol) can also be used.

Solidification Agents

The composition may optionally include a solidification agent. Exemplary solidification agents include alkali metal hydroxides, alkali metal phosphates, anhydrous sodium carbonate, anhydrous sodium sulfate, anhydrous sodium acetate, polyethylene glycol, urea, and other known waxy or hydratable compounds.

Thickener

The alkaline composition may optionally include a thickener so that the composition is a viscous liquid, gel, or semi-solid. The thickener may be organic or inorganic in nature.

Thickeners can be divided into organic and inorganic thickeners. Of the organic thickeners there are (1) cellulosic thickeners and their derivatives, (2) natural gums, (3) acrylates, (4) starches, (5) stearates, and (6) fatty acid alcohols. Of the inorganic thickeners there are (7) clays, and (8) salts. Some non-limiting examples of cellulosic thickeners include carboxymethyl hydroxyethylcellulose, cellulose, hydroxybutyl methylcellulose, hydroxyethylcellulose, hydroxypropylcellulose, hydroxypropyl methyl cellulose, methylcellulose, microcrystalline cellulose, sodium cellulose sulfate, and the like. Some non-limiting examples of natural gums include acacia, calcium carrageenan, guar, gelatin, guar gum, hydroxypropyl guar, karaya gum, kelp, locust bean gum, pectin, sodium carrageenan, tragacanth gum, xanthan gum, and the like. Some non-limiting examples of acrylates include potassium aluminum polyacrylate, sodium acrylate/vinyl alcohol copolymer, sodium polymethacrylate, and the like. Some non-limiting examples of starches include oat flour, potato starch, wheat flour, wheat starch, and the like. Some non-limiting examples of stearates include methoxy PEG-22/dodecyl glycol copolymer, PEG-2M, PEG-5M, and the like. Some non-limiting examples of fatty acid alcohols include caprylic alcohol, cetearyl alcohol, lauryl alcohol, oleyl alcohol, palm kernel alcohol, and the like. Some non-limiting examples of clays include bentonite, magnesium aluminum silicate, magnesium trisilicate, stearalkonium bentonite, tromethamine magnesium aluminum silicate, and the like. Some non-limiting examples of salts include calcium chloride, sodium chloride, sodium sulfate, ammonium chloride, and the like.

Some non-limiting examples of thickeners that thicken the non-aqueous portions include waxes such as candelilla wax, carnauba wax, beeswax, and the like, oils, vegetable oils and animal oils, and the like.

The composition may contain one thickener or a mixture of two or more thickeners. The amount of thickener present in the composition depends on the desired viscosity of the composition. The composition preferably has a viscosity from about 100 to about 15,000 centipoise, from about 150 to about 10,000 centipoise, and from about 200 to about 5,000 centipoise as determined using a Brookfield DV-II+rotational viscometer using spindle #21@20 rpm@70° F. Accordingly, to achieve the preferred viscosities, the thickener may be present in the composition in an amount from about 0 wt-% to about 20 wt-% of the total composition, from about 0.1 wt-% to about 10 wt-%, and from about 0.5 wt-% to about 5 wt-% of the total composition.

Acidic Compositions

The disclosed methods may include an acidic step wherein a concentrated acidic composition is brought directly into contact with a dish during the acidic step of the cleaning process. The acidic composition may be concentrated or diluted when it contacts the article to be cleaned. Preferably, at least one acidic composition is concentrated. The acidic composition includes one or more acids. Both organic and inorganic acids may be used.

Exemplary organic acids include hydroxyacetic (glycolic) acid, citric acid, formic acid, acetic acid, propionic acid, butyric acid, valeric acid, caproic acid, gluconic acid, itaconic acid, trichloroacetic acid, urea hydrochloride, and benzoic acid, among others. Exemplary organic dicarboxylic acids include oxalic acid, malonic acid, succinic acid, glutaric acid, maleic acid, fumaric acid, adipic acid, and terephthalic acid among others. Any combination of these organic acids may also be used intermixed or with other organic acids. Useful inorganic acids include phosphoric acid, sulfuric acid, urea sulfate, sulfamic acid, methane sulfonic acid, hydrochloric acid, hydrobromic acid, hydrofluoric acid, and nitric acid among others. These acids may also be used in combination with other inorganic acids or with those organic acids mentioned above.

An acid generator may also be used in the composition to form a suitable acid. For example, suitable generators include calcium phosphate, potassium fluoride, sodium fluoride, lithium fluoride, ammonium fluoride, ammonium bifluoride, sodium silicofluoride, etc. In one embodiment, the acid is preferably phosphoric.

In another embodiment, the acid is preferably a mixture of citric acid and urea sulfate acid. A mixture of citric acid and urea sulfate acid is especially beneficial when hard water is used because it does not create precipitates.

Exemplary concentrations of acid in a concentrate composition are described in Table 1 supra. The concentrated acidic composition preferably has a pH from about 0 to about 7, from about 1 to about 5, or from about 1 to about 3.

In the event a diluted acidic composition is employed, exemplary concentrations of acid in the diluted acidic composition include from about 0.01 wt-% to about 1 wt-%, from about 0.05 wt-% to about 0.5 wt-%, or from about 0.1 wt-% to about 0.4 wt-%. The diluted acidic composition preferably has a pH from about 0 to about 7, from about 1 to about 5, or from about 1.5 to about 3.

The acidic composition may include additional ingredients. For example, the acidic composition may include an anticorrosion agent, a thickener, a water conditioning agent, a surfactant, an enzyme, a foam inhibitor/defoaming agents, an anti-etch agent, a bleaching agent, a catalyst, a thickener, a dye or odorant, an antimicrobial agent, a hydrotrope, a binding agent, a carrier and mixtures thereof. The water conditioning agent, enzyme, enzyme stabilizing system, surfactant, bleaching agent, dye or odorant, antimicrobial agent, solidification agent, hydrotrope, antiredeposition agent, binding agent, thickener, and carrier may be selected from any those compositions previously described herein.

Surfactant

In addition to the surfactants previously described, it has been discovered that it is advantageous to put a nonionic surfactant or a cationic surfactant into the acidic compositions.

A nonionic surfactant, when included in the acidic composition and used in the method of the invention has been found to assist in preventing the formation of spots as well as assisting in the prevention of redeposition soils. The nonionic surfactant also helps in the removal or soils. A preferred nonionic surfactant is a low foaming nonionic surfactant such as Pluronic N-3, commercially available from BASF.

A cationic surfactant, when included in the acidic composition and used in the method of the invention has been found to assist in the removal of protein. Examples of preferred cationic surfactants are found in U.S. Pat. No. 6,218,349, which is hereby incorporated by reference in its entirety. The cationic surfactant is preferably diethylammonium chloride, commercially available as Glensurf 42 from Glenn Chemical (St. Paul, Minn.).

Anti-Etch Agent

The acidic composition may optionally include an anti-etch agent capable of preventing etching in glass. Examples of suitable anti-etch agents include adding metal ions to the composition such as zinc, zinc chloride, zinc gluconate, aluminum, and beryllium.

Anticorrosion Agent

The acidic composition may optionally include an anticorrosion agent. Anticorrosion agents provide compositions that generate surfaces that are shiner and less prone to biofilm buildup than surfaces that are not treated with compositions having anticorrosion agents. Preferred anticorrosion agents which can be used according to the invention include phosphonates, phosphonic acids, triazoles, organic amines, sorbitan esters, carboxylic acid derivatives, sarcosinates, phosphate esters, zinc, nitrates, chromium, molybdate containing components, and borate containing components. Exemplary phosphates or phosphonic acids are available under the name Dequest (i.e., Dequest 2000, Dequest 2006, Dequest 2010, Dequest 2016, Dequest 2054, Dequest 2060, and Dequest 2066) from Solutia, Inc. of St. Louis, Mo. Exemplary triazoles are available under the name Cobratec (i.e., Cobratec 100, Cobratec TT-50-S, and Cobratec 99) from PMC Specialties Group, Inc. of Cincinnati, Ohio. Exemplary organic amines include aliphatic amines, aromatic amines, monoamines, diamines, triamines, polyamines, and their salts. Exemplary amines are available under the names Amp (i.e. Amp-95) from Angus Chemical Company of Buffalo Grove, Ill.; WGS (i.e., WGS-50) from Jacam Chemicals, LLC of Sterling, Kans.; Duomeen (i.e., Duomeen O and Duomeen C) from Akzo Nobel Chemicals, Inc. of Chicago, Ill.; DeThox amine (C Series and T Series) from DeForest Enterprises, Inc. of Boca Raton, Fla.; Deriphat series from Henkel Corp. of Ambler, Pa.; and Maxhib (AC Series) from Chemax, Inc. of Greenville, S.C. Exemplary sorbitan esters are available under the name Calgene (LA-series) from Calgene Chemical Inc. of Skokie, Ill. Exemplary carboxylic acid derivatives are available under the name Recor (i.e., Recor 12) from Ciba-Geigy Corp. of Tarrytown, N.Y. Exemplary sarcosinates are available under the names Hamposyl from Hampshire Chemical Corp. of Lexington, Mass.; and Sarkosyl from Ciba-Geigy Corp. of Tarrytown, N.Y.

The composition optionally includes an anticorrosion agent for providing enhanced luster to the metallic portions of a dish machine.

Rinse Aid

The disclosed methods may optionally include a rinse step. The rinse step may take place at any time during the cleaning process and at more than one time during the cleaning process. The method preferably includes one rinse at the end of the cleaning process.

The rinse composition may comprise a formulated rinse aid composition containing a wetting or sheeting agent combined with other optional ingredients. The rinse aid components are water soluble or dispersible low foaming organic materials capable of reducing the surface tension of the rinse water to promote sheeting action and to prevent spotting or streaking caused by beaded water after rinsing is complete in warewashing processes.

Such sheeting agents are typically organic surfactant like materials having a characteristic cloud point. The cloud point of the surfactant rinse or sheeting agent is defined as the temperature at which a 1 wt-% aqueous solution of the surfactant turns cloudy when warmed. Since there are two general types of rinse cycles in commercial warewashing machines, a first type generally considered a sanitizing rinse cycle uses rinse water at a temperature of about 180° F., about 80° C. or higher. A second type of non-sanitizing machines uses a lower temperature non-sanitizing rinse, typically at a temperature of about 125° F., about 50° C. or higher. Surfactants useful in these applications are aqueous rinses having a cloud point greater than the available hot service water. Accordingly, the lowest useful cloud point measured for the surfactants of the invention is approximately 40° C. The cloud point can also be 60° C. or higher, 70° C. or higher, 80° C. or higher, etc., depending on the use location's hot water temperature and the temperature and type of rinse cycle.

Preferred sheeting agents, typically comprise a polyether compound prepared from ethylene oxide, propylene oxide, or a mixture in a homopolymer or block or heteric copolymer structure. Such polyether compounds are known as polyalkylene oxide polymers, polyoxyalkylene polymers or polyalkylene glycol polymers. Such sheeting agents require a region of relative hydrophobicity and a region of relative hydrophilicity to provide surfactant properties to the molecule. Such sheeting agents have a molecular weight in the range of about 500 to 15,000. Certain types of (PO)(EO) polymeric rinse aids have been found to be useful containing at least one block of poly(PO) and at least one block of poly(EO) in the polymer molecule. Additional blocks of poly(EO), poly(PO) or random polymerized regions can be formed in the molecule. Particularly useful polyoxypropylene polyoxyethylene block copolymers are those comprising a center block of polyoxypropylene units and blocks of polyoxyethylene units to each side of the center block. Such polymers have the formula shown below:

$$(EO)n\text{-}(PO)m\text{-}(EO)n$$

wherein n is an integer of 20 to 60, each end is independently an integer of 10 to 130. Another useful block copolymer are block copolymers having a center block of polyoxyethylene units and blocks of polyoxypropylene to each side of the center block. Such copolymers have the formula:

$$(PO)n\text{-}(EO)m\text{-}(PO)n$$

wherein m is an integer of 15 to 175 and each end are independently integers of about 10 to 30. The rinse aid composition can include a hydrotrope to aid in maintaining the solubility of sheeting or wetting agents, or a bleaching agent for lightening or whitening a substrate. Exemplary hydrotropes and bleaching agents have been described supra. The rinse aid composition may be applied to the article as a concentrate or as a diluted composition.

All publications and patent applications in this specification are indicative of the level of ordinary skill in the art to which this invention pertains. All publications and patent applications are herein incorporated by reference to the same extent as if each individual publication or patent application was specifically and individually indicated as incorporated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

Example 1

The effects of using highly concentrated alkalinity and highly concentrated acidity in an alternating alkaline-acid-alkaline dishwashing procedure were evaluated to determine the cleaning performance achieved by use of the highly concentrated products. Four dishmachine experiments were run to clean three different soil types from ceramic tiles, as set forth below:

1. Conventional alkaline-acid-alkaline process with normal concentrations of detergent (alkalinity) (1.0 g/L) and acid (1.5 g/L=0.15% acid product).
2. Alkaline-acid-alkaline process with the 1st alkaline step utilizing a direct spray of concentrated alkalinity (500 g/L=50% detergent).
3. Alkaline-acid-alkaline process with the acid step utilizing a direct spray
4. of concentrated acid (500 g/L=50% acid product). Alkaline-acid-alkaline process for which both the 1st alkaline step and
   the acid step utilize a direct spray of concentrated products (500 g/L each concentrated product).

An Apex HT dishmachine (wash tank volume 30 liters; final rinse volume 3.5 liters) was used for all experiments and used 17 gpg water hardness. The cycle times (seconds), water usages, and temperatures were kept constant for all tests as shown in Table 2.

TABLE 2

| | Std Run 1 | Conc. Alk Run 2 | Conc. Acid Run 3 | Conc. Alk/Acid Run 4 |
|---|---|---|---|---|
| 1st Alkaline Wash | 10 | Spray direct, | 10 | Spray direct, |
| Pause | 5 | 15 sec. total | 5 | 15 sec. total |

TABLE 2-continued

| | Std Run 1 | Conc. Alk Run 2 | Conc. Acid Run 3 | Conc. Alk/Acid Run 4 |
|---|---|---|---|---|
| Acid Rinse | 5 | 5 | Spray direct, | Spray direct, |
| Pause | 10 | 10 | 15 sec. total | 15 sec. total |
| $2^{nd}$ Alkaline Wash | 15 | 15 | 15 | 15 |
| Pause | 2 | 2 | 2 | 2 |
| Final Rinse | 11 | 11 | 11 | 11 |
| Total (seconds) | 58 | 58 | 58 | 58 |

For the concentrated alkalinity and/or acid (500 g/L dosage) the product was sprayed directly onto the dishes with a spray nozzle. For the 1.0 g/L detergent dosage (conventional application) the conductivity controller of the dishmachine was used to maintain the 1.0 g/L level in wash tank. The experiments were conducted to quantify the effects of using concentrated compositions instead of the conventional, more dilute product solutions in a dishwashing machine. Both the cleaning performance effect and the chemical consumption differences were measured.

Measurements and results: The cleaning performance results were evaluated by taking photos of the ceramic tiles before (prewash) and after washing (post wash). Digital images were also taken as a means to quantify the percent soil removal using the 4 different dishmachine experiments. The amount of each product used each cycle was obtained by weighing each product container before and after each cycle. The detailed test conditions are set forth in Table 3.

The use of the concentrated products cleaned much better (96% to 100% removal) compared to the conventional process (32% removal) on tea stains. All tests performed similarly on the tea and milk (combination) stains, although the conventional process (97%) was slightly worse than all others (100%). Despite the non-statistical significance of this cleaning difference for the combination stain, the differences were visually apparent in the photographs and appearance of the ware. The use of concentrated alkaline spray (run #2) outperformed all other experiments on the starch stains. The highly-concentrated alkalinity removed 95% soils as compared to 7%-10% removal for the other experiments and 7% removal achieved by the conventional process.

Overall, the experiments indicate that according to the present invention a cleaning performance improvement can be obtained when using concentrated products sprayed directly onto the soiled surfaces.

Example 2

The effects of using highly concentrated alkalinity and highly concentrated acidity in an alternating alkaline-acid-alkaline dishwashing procedure were further evaluated to determine the chemical usage reduction achieved by use of the highly concentrated products. The materials and methods set forth in Example 1 were employed.

For the conventional process, the detergent was charged up by using the conductivity controller, as is normal. However, for the concentrated alkaline spray process, there is no need for a conductivity controller. The concentrated alkaline spray drains from the dishes and ends up in the wash tank and thus keeps the wash tank charged up automatically. Thus, the second alkaline wash step is dosed with detergent automatically from the concentrated first alkaline wash step.

For these experiments, the steady-state conditions were used for the cleaning performance evaluations. That is, the

TABLE 3

| | Products/Concentration | | | | Actual Dosage Measured During Test | | | |
|---|---|---|---|---|---|---|---|---|
| | | | | | Initial Tank Charge | | Cycle 2, 3, 4 Charges | |
| Run | Target Detergent | g/L | Target Acid | g/L | Detergent (g) | Acid (g) | Detergent (g) | Acid (g) |
| 1 | Solid Power | 1.0 | Urea Sulfate 54%, Citric Acid 10% | 1.5 | 30.0 | 12.2 | 3.5 | 5.3* |
| 2 | Solid Power | 500.0 | Urea Sulfate 54%, Citric Acid 10% | 1.5 | 26.6 | 12.2 | 3.1 | 5.3* |
| 3 | Solid Power | 1.0 | Urea Sulfate 54%, Citric Acid 10% | 500.0 | 30.0 | 8.1 | 3.5 | 3.5 |
| 4 | Solid Power | 500.0 | Urea Sulfate 54%, Citric Acid 10% | 500.0 | 25.7 | 8.1 | 3.0 | 3.2 |

*The dosing for the acid used in the conventional process (runs 1 and 2) was dosed above the amounts required to deliver a pH of 2.0. Instead, a pH of 1.2, which is lower than normally used, was achieved.

Cleaning Performance Results. The application of a concentrated spray of product provided equal (i.e. substantially similar) or better cleaning performance on all soils. The results are shown in Table 4. The pH for the spray bottle (acid) was 0, and the pH for the spray bottle (alkalinity) was 11.3.

TABLE 4

| | Tile # | | | Tile Results (% Soil Removed) | | | | | Temperatures | |
|---|---|---|---|---|---|---|---|---|---|---|
| Run | Stain | Soil | Starch | Tea | Tea/ Milk | Starch | Wash pH | Water (gpg) | Wash | Final Rinse |
| 1 | B 120 | C 120 | E 95 | 32 | 97 | 7 | 10.0 | 16 | 150 | 178 |
| 2 | B 116 | C 118 | E 91 | 96 | 100 | 95 | 10.2 | 17.7 | — | — |
| 3 | B 115 | C 117 | E 97 | 100 | 100 | 10 | 10.6 | 18 | 153 | 176 |
| 4 | B 114 | C 119 | E 102 | 99 | 100 | 10 | 10.4 | 17.5 | 156 | 176 |

wash tanks were fully charged up with both detergent and acid as though the dishmachine had been running for 50 cycles or more. The concentrations of each product were approximated and added to the wash tank to simulate the steady state conditions. Product consumption of the initial tank charge are not factored in to the product consumption savings because these tank charges become insignificant after running multiple cycles, 50 or more. The main consumption driver in a dishmachine operation is the product usage during each cycle.

Product Consumption Results. The conventional process used an average of 3.5 grams of detergent and 5.3 grams of acid for each cycle. The use of concentrated alkaline spray used an average of 3.05 grams of detergent per cycle, representing about a 12.9% reduction in consumption of the alkaline detergent. The use of concentrated acid spray used an average of 3.35 grams of acid per cycle, representing about a 36.8% reduction in consumption of the acidic composition. It is estimated that the percent reduction of acidic composition is elevated as a result of the increased dosing of the acid in the conventional processes (runs 1 and 2, described above). Overall, the experiments demonstrate the efficacy of the present invention for obtaining an overall reduction in chemical product usage when using concentrated products sprayed directly onto the soiled surfaces.

The inventions being thus described, it will be obvious that the same may be varied in many ways. Such variations are not to be regarded as a departure from the spirit and scope of the inventions and all such modifications are intended to be included within the scope of the following claims. Since many embodiments can be made without departing from the spirit and scope of the invention, the invention resides in the claims.

We claim:

1. A method of cleaning an article in a dishmachine comprising:

applying directly to the article a first concentrated cleaning composition, wherein the direct application contacts the article itself and not apply the composition to a sump or otherwise dilute the composition prior to contacting the article, comprising: (i)

from about 50 wt-% to about 90 wt-% of a source of alkalinity or a source of acidity; (ii) optional materials selected from the group consisting of surfactant, thickener, chelating agent, bleaching agent, catalyst, enzyme, solidification agent and mixtures thereof; and (iii) water, wherein the first concentrated cleaning composition has at least 20 wt-% active ingredients; and applying to the article a second composition selected from the group consisting of a first acidic cleaning composition, a first alkaline cleaning composition, a second acidic cleaning composition, a second alkaline cleaning composition, a rinse aid composition and mixtures thereof.

2. The method of claim 1, wherein the first concentrated cleaning compositions directly contacts any soils on the articles.

3. The method of claim 1, wherein first concentrated cleaning composition has from about 2 times to about 400 times greater percentage of active ingredients than a concentration of actives in the sump of the dishmachine.

4. The method of claim 1, wherein the methods achieve at least substantially similar cleaning efficacy to methods employing less concentrated compositions, methods applying compositions to a sump and/or otherwise diluting compositions to apply a ready-to-use composition to the article.

5. The method of claim 1, wherein the dishmachine is an institutional dish machine or a consumer dishmachine.

6. The method of claim 5, wherein the dish machine is selected from the group consisting of a door dish machine, a hood dish machine, a conveyor dish machine, an undercounter dish machine, a glasswasher, a flight dish machine, a pot and pan dish machine and a utensil washer.

7. The method of claim 1, wherein the source of alkalinity is selected from the group consisting of sodium hydroxide, potassium hydroxide, sodium carbonate, sodium bicarbonate, sodium silicate, and mixtures thereof, and wherein, wherein the source of acidity is selected from the group consisting of urea sulfate, urea hydrochloride, sulfamic acid, methanesulfonic acid, citric acid, gluconic acid and mixtures thereof.

8. The method of claim 1, wherein the method further comprises applying to the article a third composition selected from the group consisting of a second acidic cleaning composition, a second alkaline cleaning composition, a rinse aid composition and mixtures thereof.

9. The method of claim 1, wherein the first concentrated cleaning composition has at least from about 500 ppm to about 2000 ppm alkalinity or acidity source.

10. The method of claim 1, wherein the method achieve at least a 10% reduction in alkalinity and/or acidic cleaning composition consumption while achieving at least substantially similar cleaning efficacy to methods employing less concentrated compositions as a result of the composition being applied to a sump of a dishmachine.

11. The method of claim 1, wherein the method provides superior cleaning efficacy compared to methods employing less concentrated alkalinity and/or acidic cleaning compositions.

12. A method of cleaning an article in a dishmachine comprising:

forming a concentrated alkaline or acidic cleaning composition by dissolving a portion of a solid alkaline or acidic cleaning composition with water, the concentrated alkaline or acidic cleaning composition comprising: (i) from about 50 wt-% to about 90 wt-% of a source of alkalinity or a source of acidity; (ii) optional materials selected from the group consisting of surfactant, thickener, chelating agent, bleaching agent, catalyst, enzyme, solidification agent, and mixtures thereof; and (iii) water;

spraying the concentrated alkaline or acidic cleaning composition directly onto an article to be cleaned through a wash arm, rinse arm, additional spray arm or a spray nozzle in the dish machine, wherein the direct application of the concentrated composition contacts the article itself and does not apply the composition to a sump or otherwise dilute the composition prior to contacting the article, wherein the composition has from about 500 ppm to about 2000 ppm alkalinity or acid source, which is about 2 times to about 400 times greater active ingredient than a concentration of actives in a sump of the dishmachine; and applying to the article a second composition selected from the group consisting of a first acidic cleaning composition, a first alkaline cleaning composition, a second acidic cleaning composition, a second alkaline cleaning composition, a rinse aid composition, and mixtures thereof, wherein the methods achieve at least substantially similar cleaning efficacy in comparison to methods employing less concentrated compositions, compositions applied to a sump and/or compositions diluted prior to application to the article, wherein the methods employing concentrated compositions provide at least a 10% reduction in alkalinity and/or acidic cleaning composition consumption in comparison to methods employing less concentrated compositions, compositions applied to a sump and/or compositions diluted prior to application to the article.

13. The method of claim 12, wherein the solid alkaline or acidic cleaning composition is a solid block.

14. The method of claim 12, wherein the methods provide superior cleaning efficacy in comparison to methods employing less concentrated compositions, compositions applied to a sump and/or compositions diluted prior to application to the article.

15. The method of claim 12, wherein the dishmachine is an institutional dish machine or a consumer dishmachine.

16. The method of 12, wherein the concentrated alkaline or acidic cleaning composition directly contacts any soils on the articles.

17. A method of cleaning an article in an institutional or consumer dishmachine comprising:

forming a concentrated alkaline cleaning composition by dissolving a portion of a solid block with water, the concentrated alkaline cleaning composition having from about 500 ppm to about 2000 ppm active alkalinity comprising: (i) from about 50 wt-% to about 90 wt-% of a source of alkalinity; (ii) optional materials selected from the group consisting of surfactant, thickener, chelating agent, bleaching agent, catalyst, enzyme, solidification agent, and mixtures thereof; and (iii) water;

spraying the concentrated alkaline cleaning composition directly onto an article to be cleaned through a wash arm, rinse arm, additional spray arm or a spray nozzle in the dish machine, wherein the composition directly contacts any soils on the articles does not apply the composition to a sump or otherwise dilute the composition prior to contacting the article; and spraying a concentrated acidic cleaning composition directly onto an article to be cleaned through a wash arm, rinse arm, additional spray arm or a spray nozzle in the dish machine, wherein the composition directly contacts any soils on the articles, and wherein the acidic cleaning composition comprising: (i) from about 20 wt-% to about 80 wt-% of an acid; (iii) optional materials selected from the group consisting of surfactant, thickener, chelating agent, bleaching agent, catalyst, enzyme, solidification agent, and mixtures thereof; and (iii) water, wherein the concentrated alkaline and/or acidic cleaning compositions have from about 2 times to about 400 times greater percentage of active ingredients than a concentration of actives in the sump of the dishmachine, wherein the methods employing concentrated compositions provide at least a 10% reduction in alkalinity and/or acidic cleaning composition consumption in comparison to methods employing less concentrated compositions, compositions applied to a sump and/or compositions diluted prior to application to the article.

18. The method of claim 17, wherein the methods provide superior cleaning efficacy to methods employing less concentrated compositions, methods applying compositions to a sump and/or otherwise diluting compositions to apply a ready-to-use composition to the article.

19. The method of claim 17, further comprising applying a rinse aid to the article to be cleaned.

20. The method of claim 17, further comprising pauses in between the application of the alkaline cleaning and the acidic cleaning, wherein no cleaning agent is applied to the article and the previously applied cleaning agent is allowed to stand on the article for a period of time.

* * * * *